US009062450B2

(12) United States Patent
Philibert et al.

(10) Patent No.: US 9,062,450 B2
(45) Date of Patent: Jun. 23, 2015

(54) MODULAR DWELLINGS

(75) Inventors: Carl Philibert, Surrey (CA); Andrew Ronan, Vancouver (CA); James Lee, Vancouver (CA); Jared A. Schmale, Vancouver (CA); Matthew Hunsberger, Vancouver (CA)

(73) Assignees: Larrie A. Novak, Langley (CA); Carl Philibert, Surrey (CA)

( * ) Notice: Subject to any disclaimer, the term of this patent is extended or adjusted under 35 U.S.C. 154(b) by 15 days.

(21) Appl. No.: 14/116,744

(22) PCT Filed: May 3, 2012
(Under 37 CFR 1.47)

(86) PCT No.: PCT/CA2012/000409
§ 371 (c)(1),
(2), (4) Date: Sep. 12, 2014

(87) PCT Pub. No.: WO2012/151665
PCT Pub. Date: Nov. 15, 2012

(65) Prior Publication Data

US 2014/0069032 A1 Mar. 13, 2014

(30) Foreign Application Priority Data

May 9, 2011 (CL) ..... 1031-2011

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 1/343*** | (2006.01) |
| ***E04B 1/19*** | (2006.01) |
| ***E04H 1/02*** | (2006.01) |

(52) U.S. Cl.
CPC ..... *E04B 1/34321* (2013.01); *E04H 1/005* (2013.01); *E04B 1/1903* (2013.01); *E04H 1/02* (2013.01)

(58) Field of Classification Search
CPC ..... E04B 1/34321; E04B 1/19; E04B 1/1903; E04B 1/344; E04B 1/3442; E04B 2001/34389
USPC ..... 52/79.1, 79.5, 92.1, 465, 648.1, 653.1, 52/690, 691, 645, 64, 44
See application file for complete search history.

(56) References Cited

U.S. PATENT DOCUMENTS 3,196,499 A * 7/1965 Houvener ..... 52/794.1
3,983,665 A * 10/1976 Burton ..... 52/71

(Continued)
FOREIGN PATENT DOCUMENTS

| | | |
|---|---|---|
| CA | 1067668 | 12/1979 |
| CA | 2000225 A1 | 10/1997 |
| WO | WO 2012/151665 A1 | 11/2012 |

OTHER PUBLICATIONS

International Search Report and Written Opinion dated Sep. 11, 2012, issued by the International Searching Authority in International Application No. PCT/CA2012/000409, filed May 3, 2012.

*Primary Examiner* — Brian Glessner
*Assistant Examiner* — Brian D Mattei
(74) *Attorney, Agent, or Firm* — Klarquist Sparkman, LLP

(57) ABSTRACT

Modular dwellings comprise attached wall members that enclose an interior area, and a central truss system extending across the dwelling. A lower roof member is supported by a truss system lower chord and wall member, and an upper roof member is supported by a truss system upper chord and a wall member. The ends of the truss system are supported by a vertical post. The upper part of a wall section and of the upper chord are in co-planar alignment and the lower chord and the upper part of another wall section are in co-planar alignment. Wall panels include an internal frame and a tongue on one side and a groove on the other side which mate with the tongues and grooves of other like panels to compress resiliently deformable seals. A frame portion positioned at the internal side of the extension supports the extension for proper alignment during construction.

21 Claims, 24 Drawing Sheets

(56) References Cited

U.S. PATENT DOCUMENTS

| | | | | |
|---|---|---|---|---|
| 4,891,919 | A * | 1/1990 | Palibroda | 52/79.5 |
| 5,509,242 | A * | 4/1996 | Rechsteiner et al. | 52/270 |
| 6,189,269 | B1 * | 2/2001 | De Zen | 52/220.5 |
| 2006/0191211 | A1 * | 8/2006 | Colquhoun | 52/64 |
| 2009/0308016 | A1 * | 12/2009 | Strickland et al. | 52/636 |
| 2010/0218436 | A1 * | 9/2010 | Colquhoun | 52/79.5 |
| 2010/0287858 | A1 * | 11/2010 | Israeli et al. | 52/220.7 |
| 2010/0325989 | A1 * | 12/2010 | Leahy | 52/270 |
| 2012/0279142 | A1 * | 11/2012 | Michaud | 52/79.5 |

* cited by examiner

MODULAR DWELLINGS

CROSS REFERENCE TO RELATED APPLICATIONS

This is the U.S. National Stage of International Application No. PCT/CA2012/000409, filed May 3, 2012, which was published in English under PCT Article 21(2), which in turn claims priority to Chile Application No. 1031-2011, filed May 9, 2011.

BACKGROUND OF THE INVENTION

The invention is directed to improvements to modular dwellings and more specifically is directed to improvements to such dwellings that include roof panels and a truss system for a roof of a dwelling in which horizontal truss members support one set of roof panels from an upper region of the truss system and support another set of roof panels from a lower region of the truss system. The sets of roof panels extend outwardly in opposite directions from the truss members supported by opposite walls of the dwelling. The truss members are supported only at each end thereby forming a large inner area of the dwelling beneath the roof panels and truss system free of internal support members. The truss members may include inner windows permitting natural light to enter the dwelling from outside.

SUMMARY OF THE INVENTION

In an embodiment of the invention a modular dwelling provides a plurality of wall members attached together to enclose an interior of the modular dwelling; a truss system extending across the dwelling supported at each end by a vertical post, the truss system is positioned horizontally with a lower chord and an upper chord where the lower chord defines a support. A lower roof member includes a first end supported by the support and includes a second end region opposite the first end supported by a first wall section of the dwelling. An upper roof member includes a first end supported by the upper chord and includes a second end region opposite the first end in a direction opposite to that of the lower roof member and supported by a second wall section of the dwelling. The upper surface of the second wall member and the upper surface of the truss system are angled in co-planar alignment in an upper roof plane extending downwardly from the upper surface of the truss system to the upper surface of the second wall section.

Alternatively the support of the lower roof member may be oriented above the first wall member so that the lower roof member is slanted downwardly from the first end to the second end region.

As an alternative, the upper surface of the first wall member and the support surface are angled in co-planar alignment in a lower roof plane extending downwardly from the support surface to the upper surface of the first wall member.

As an alternate embodiment the first wall member may include a lower roof extension extending inwardly from the first wall member along the lower roof plane. Or further the second wall member may include an upper roof extension extending inwardly from the second wall member along the upper roof plane.

As a further alternative the support and upper periphery of the first wall member may be substantially co-planar so that the lower roof member is substantially horizontal.

As another alternative, the upper and lower roof members may include a plurality of roof sections aligned along their longitudinal sides. Each roof section includes a first groove extending laterally along a first longitudinal side of the roof section with a concave inner region extending along the first side facing downwardly when the roof section is on the dwelling and a first tongue extending upwardly from the upper face of the roof section along the opposite longitudinal side of the roof section configured to mate with the first groove. The first groove of a roof section covering a first tongue of an adjacent roof section when the roof section is on the dwelling. As well as a second groove having a concave inner region facing laterally in the direction of the lateral extension of the first groove extending along the first longitudinal side and a second tongue extending laterally along the opposite longitudinal side of the roof section configured to mate with the second groove. The second groove of a roof section covering a second tongue of an adjacent roof section when the roof section is on the dwelling.

As another alternative, the upper and lower sides of the lower roof member may be tapered so that the upper surface of the lower roof member is slanted downwardly from the first end to the second end region.

The support may define a channel with upper and lower horizontal members and wherein the first end of the lower roof members is positioned within the channel for support by the truss system. The upper and lower roof members may each include a plurality of roof panels connected together at contacting edges and extending from a first end supported by the support and a second end region supported by the wall members.

As an alternative, the truss system may include a series of discrete truss members connected together in end to end linear alignment wherein each truss including upper and lower channels, each upper and lower channel extending inwardly from upper and lower ends of each truss member and further including a plurality of connectors each connector dimensioned to fit within the upper or lower channel of adjacent truss members and connectable thereto to secure the adjacent truss members together.

An alternate embodiment provides a wall member of a modular dwelling configured for side-by-side attachment to another like wall member includes an outer side, an inner side and first and second end members. The first end member includes an outer extension and the second end member includes a groove for mating with the extension of the another like wall member. A first resiliently deformable gasket is positioned longitudinally along the first end on the side of the extension toward the outer side of the wall member and a second resiliently deformable gasket is positioned longitudinally along the first end within the groove. When the wall member is joined to another like wall member by the extension of one of the wall members connected within the groove of the another like wall member the gaskets are compressed to form a seal between the wall members.

As an alternative the wall member includes a frame positioned internally with portions adjacent each of the first and second ends of the wall member to support the extension and groove wherein when the wall member is joined to another like wall member the frames of the adjacent ends are in longitudinal alignment. A connector is provided for connecting the wall members together by connecting the aligned frames together.

As a further alternative, the connector includes a base member and a pair of opposed lateral extensions with the base member dimensioned in length such that the extensions are positioned about respective frames to secure the wall members together with the gaskets compressed to form the seal, when the wall members are connected together.

As yet another alternative, the extension includes an inner cavity and at least a portion of the frame adjacent the first side is positioned within the cavity.

As another alternative a pair of spacers are positioned along the second end member to position the portion of the frame adjacent the second end at a predetermined location with respect to the inner and outer sides and wherein the frame within the cavity positions the portion of the frame adjacent the first side at the predetermined location.

DESCRIPTION OF PREFERRED EMBODIMENTS

Figure 1A:
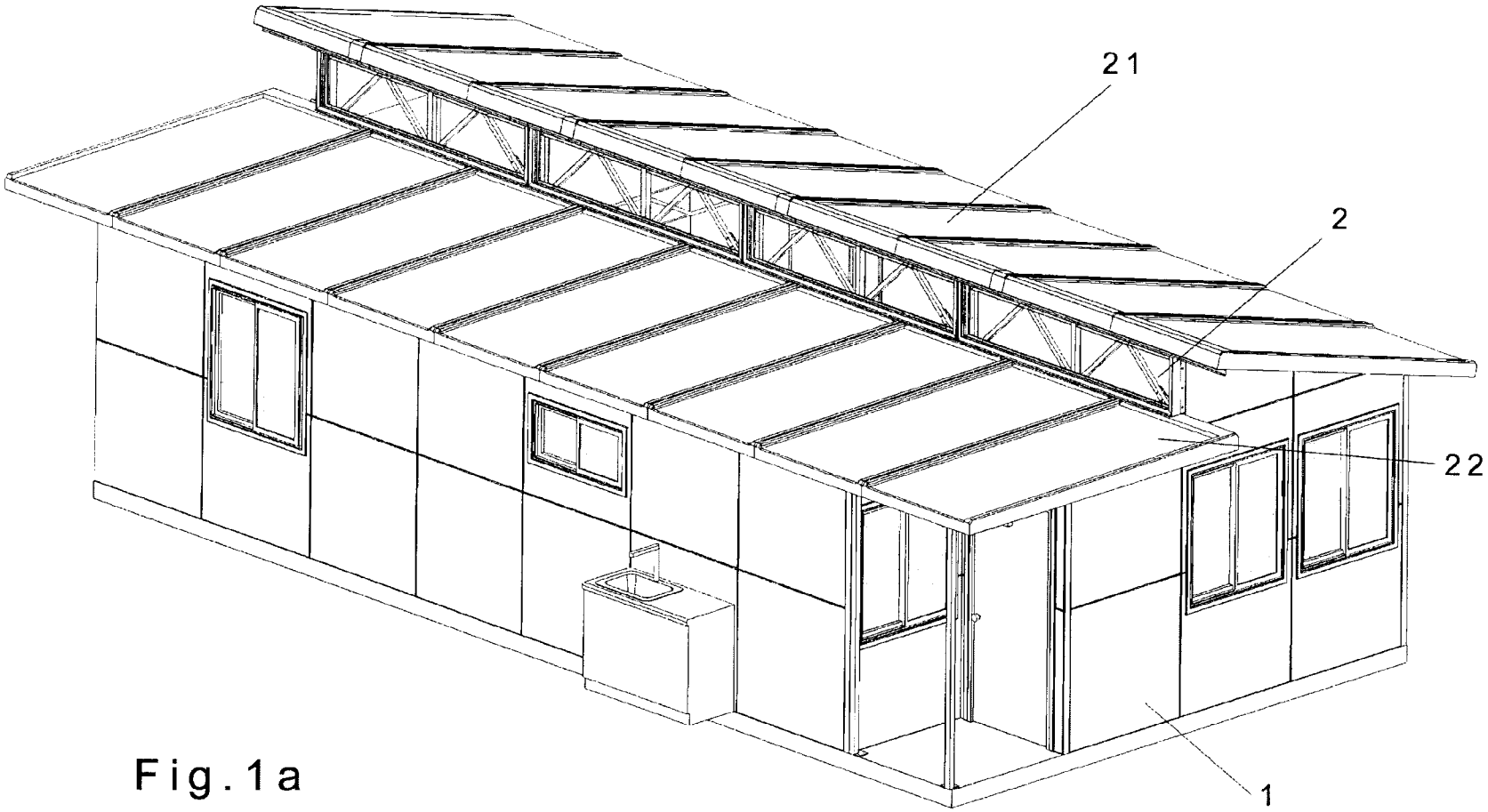
FIG. 1*a* is a perspective view, viewed from above, of an assembled modular dwelling in accordance with an embodiment of the invention.

One embodiment of the invention is shown in FIG. 1*a* depicting an assembled modular dwelling. Wall panels 1 (or wall members) are bolted together around the periphery of concrete pad 33 (shown in FIG. 6) to create walls with a co-planar upper periphery which act as vertical structural elements and insular elements of the dwelling. In an alternative embodiment, concrete pad 33 may be a sub-floor, as discussed with reference to FIGS. 10-13. A modular truss system 2 is comprised of four truss assemblies 9 (or truss members) (FIG. 4*b*) which span the length of the dwelling. Although other numbers of truss assemblies 9 are also contemplated. A pair of composite roof panel assemblies, angled roof panel assembly 21 and flat roof panel assembly 22, made up of a series of connected panels cover the dwelling.

Each truss assembly 9 accommodates a rectangular double glass pane window 19 that acts as a thermal barrier to the outside elements and provides a method for ambient light to flood the inside of the dwelling, thereby decreasing the need for additional incandescent or fluorescent light sources. Optionally the window may be single pane or panels and windows may be placed in alternate truss assemblies 9 or otherwise mixed.

In an embodiment of the invention flat composite roof panels 22 may measure 1.2 m×2.9 m for example and angled composite roof panels 21 may measure 1.2 m×2.9 m for example although other sizes are also possible. As well, truss system 2 may be 9.6 m in length and 0.6 m in height, and can be made entirely of steel. A double glass pane window 19 may be of dimensions 2.4 m×0.6 m for example.

Figure 1B:
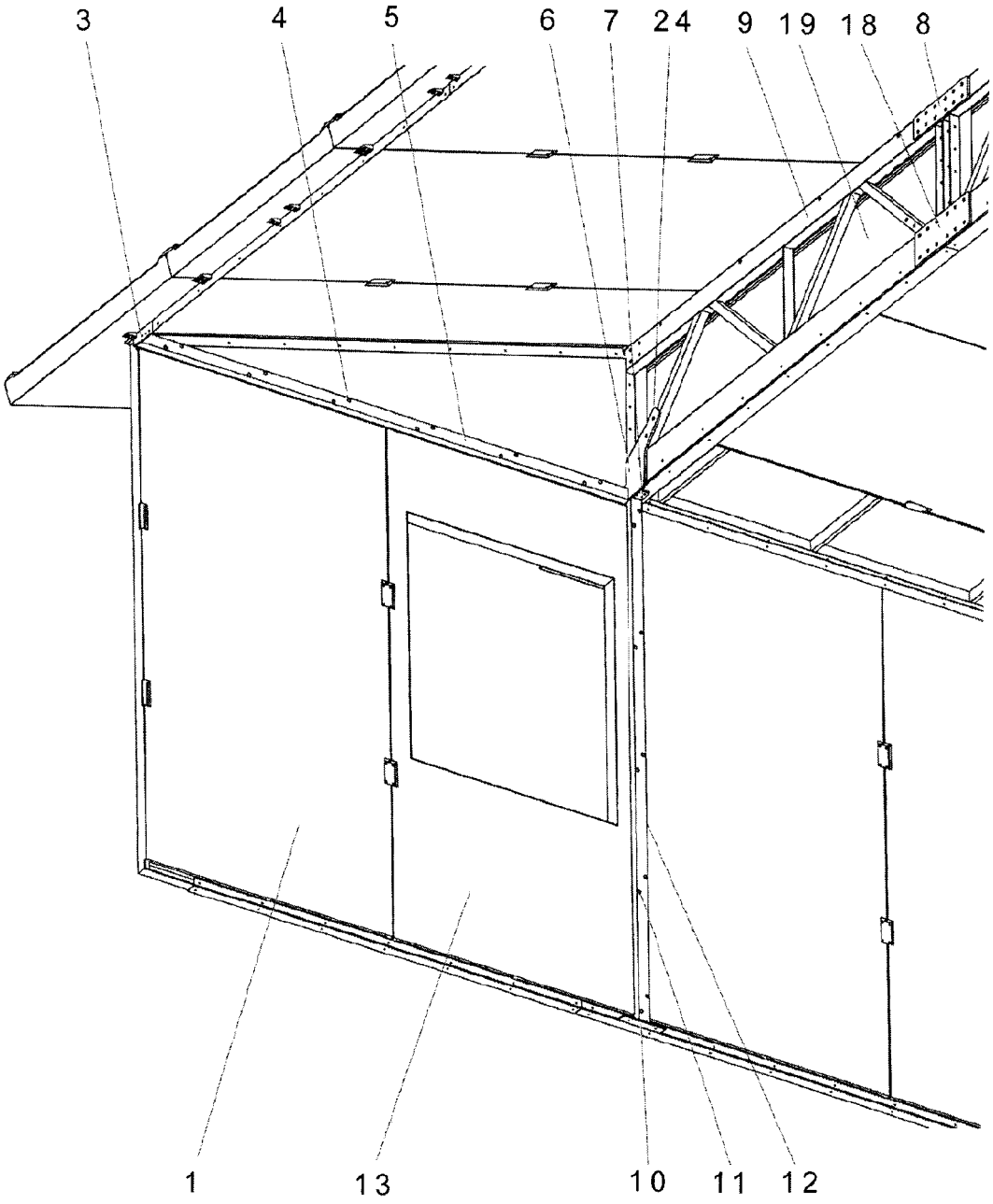
FIG. 1*b* is a perspective view, viewed from below, of an inner region of the dwelling of FIG. 1*a* with the sub-floor removed showing the steel bracket details of one of the end walls including horizontal beams and vertical posts supporting the end of the truss system.

FIG. 1*b* is a view from the interior of the dwelling, looking upwards. End truss assembly 9 is partially supported at its end by the top of adjacent wall panels 1. However, the load of the truss 9, roof panels 22, 23 and any additional snow loads in winter necessitate the need for post 12 to also support this load. A post 12, also shown separately in FIG. 2*b*, is located at each end of the truss system 2 and is positioned directly under the bottom of the corresponding end truss assembly 9. Post 12 is attached to truss assembly 9 by screws for example at the top of the post 12 through the supporting plate 7 which may be ¼" thick for example. The bottom of post 12 is affixed to the concrete pad 33 (FIG. 6) or subfloor via plate 10, using fasteners for affixing to a subfloor or HILTI nails for example where the wall is placed directly onto concrete pad 33. Additional fasteners used in pre-drilled hole locations 11 allow the post 12 to be attached to the outer frame of adjacent wall panel 1, creating additional buckling support.

Figure 2A:
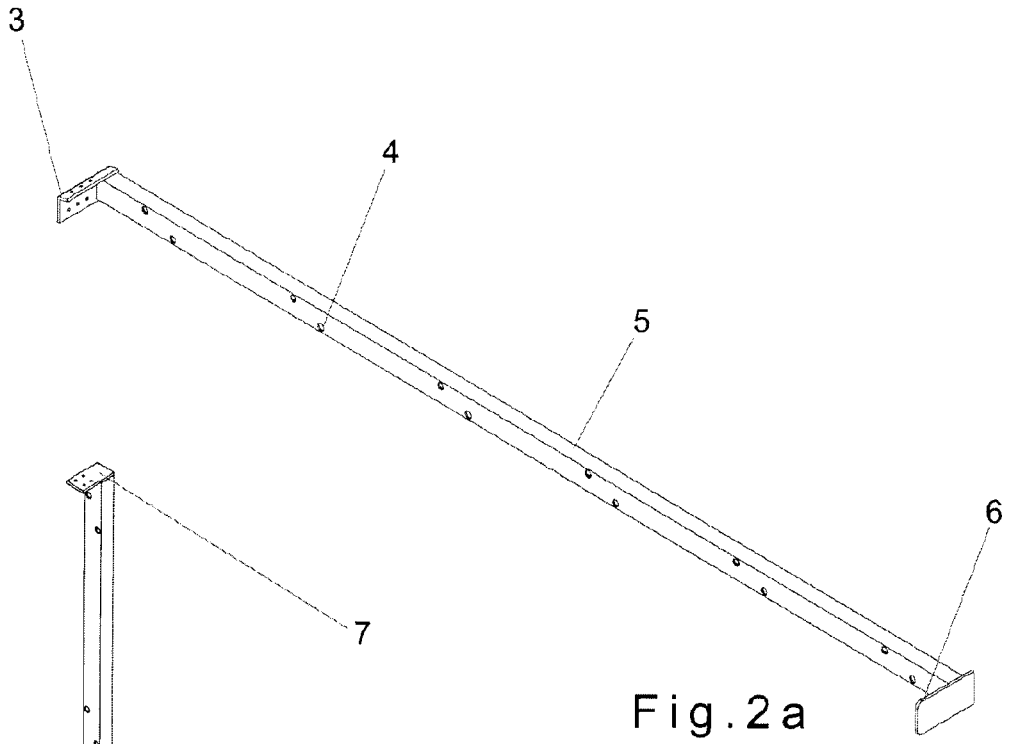
FIG. 2*a* is a perspective view of the horizontal beam at the top and bottom of the triangular gusset panel of the dwelling of FIG. 1*a*.
Figure 2B:
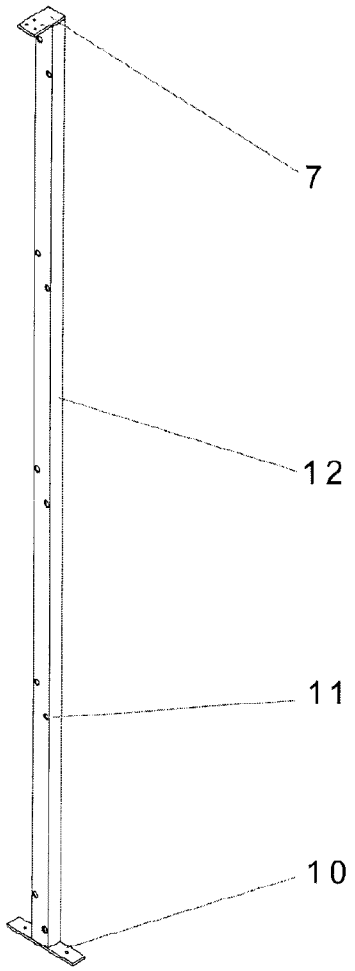
FIG. 2*b* is a perspective view of one of the vertical post at both ends of the truss system to support the truss system and adjacent roof panels, of the dwelling of FIG. 1*a*.

In addition to post 12, FIG. 1*b* also shows the location of horizontal beam 5, which is also shown in FIG. 2*a*. Horizontal beam 5 ties together the bottom of the triangular panel that is inserted in the gable end to fill the gap created by the angling of roof panel 21 and the top of the two adjacent wall panels 1. A first end of horizontal beam 5 is affixed to truss assembly 9 via the plate 6 that is welded to one end of horizontal beam 5. Plate 6 is affixed via two bolts that are also used to affix gusset 24 and large bridge plates 18 in truss assembly 9. The holes in plate 6 are drilled on site to assure correct alignment with the pre-drilled holes on truss assembly 9. A second end of horizontal beam 5 has a pre-bent plate 3 welded thereon with six pre-drilled holes to accommodate screws. These holes are used to secure the entire upper corner assembly at this location, namely tying together the tops of the two perpendicular wall panels 1 at the adjacent corner of the dwelling and tying angled roof panel 21 together in this upper inside corner of the dwelling. Horizontal beam 5 will also be affixed to internal tubular steel frames at the top of the wall panels 1 and the bottom of the triangular panel via screws that bolt through pre-drilled holes 4.

Figure 3A:
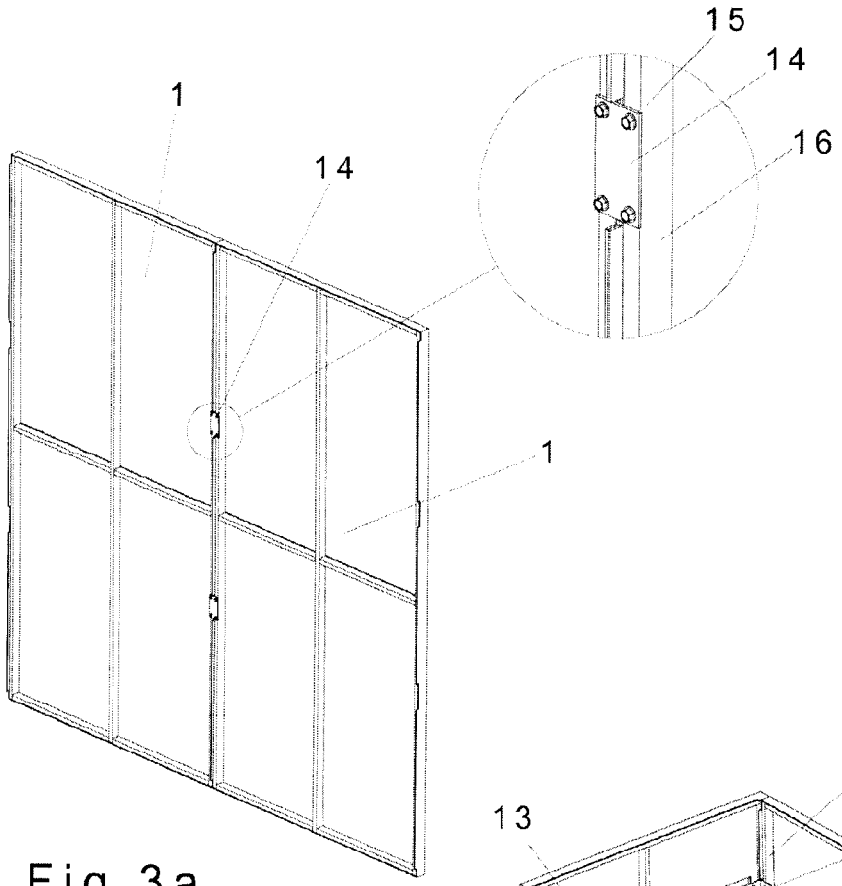
FIG. 3*a* is a perspective view, and a close-up view, of the connection detail of two wall panels joined together with two steel plate brackets, of the dwelling of FIG. 1*a*.
Figure 9A:
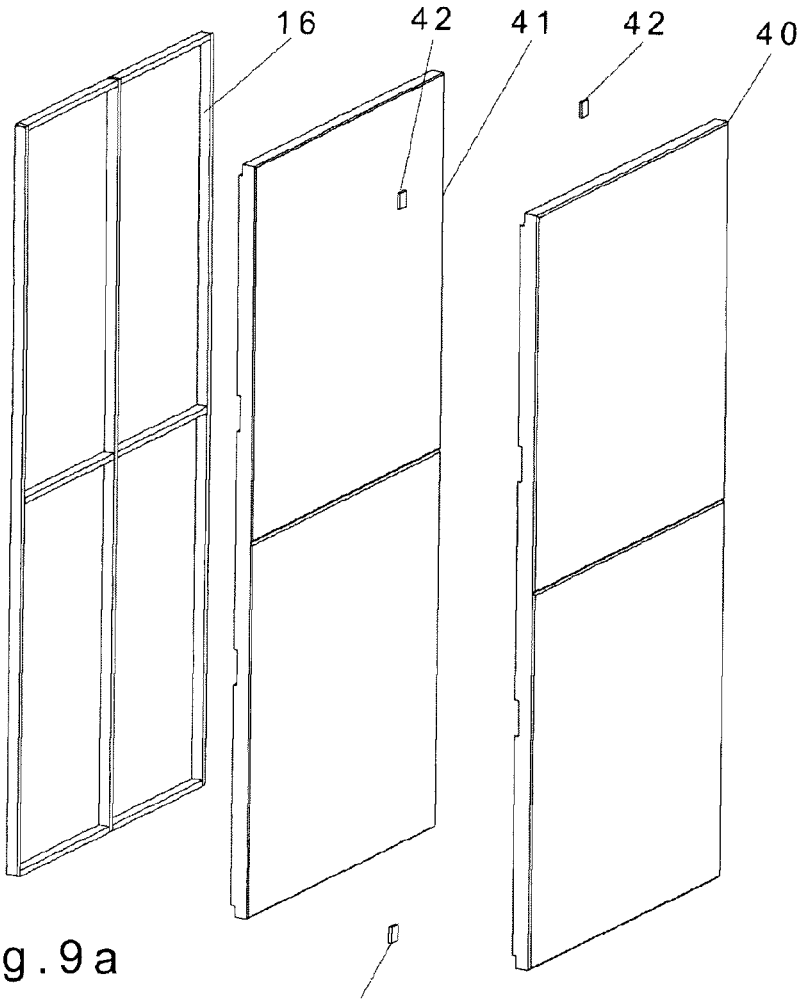
FIG. 9*a* is an exploded perspective view of a wall panel of the dwelling of FIG. 1*a*.
Figure 9B:
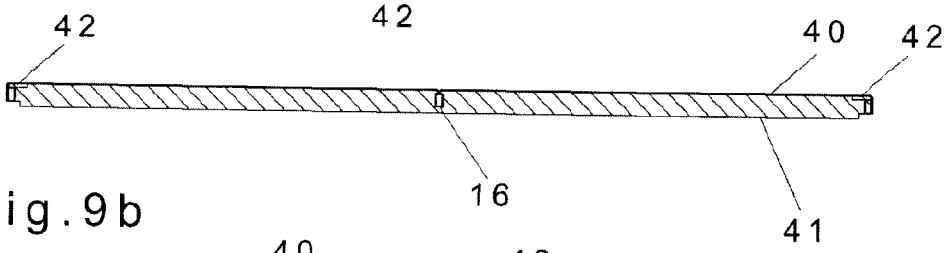
FIG. 9*b* is a cross-sectional view of a wall panel of the dwelling of FIG. 1*a*.
Figure 9C:
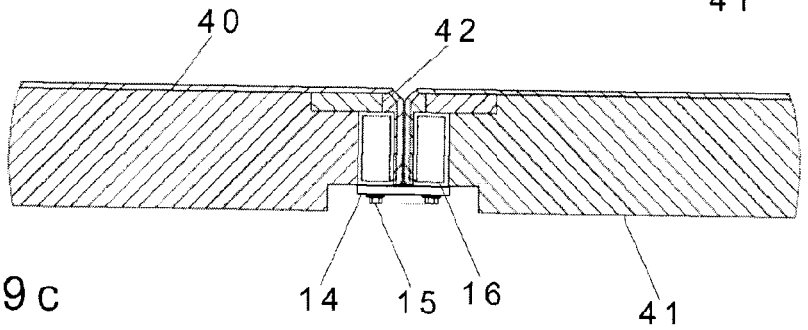
FIG. 9*c* is a cross-sectional close-up view of connecting portions of two adjacent wall panels of the dwelling of FIG. 1*a*.

FIGS. 3*a* and 9*c* show a wall panel 1 joined to an adjacent wall panel 1 via at least one flat steel plate 14. The four holes in flat steel plate 14 line up with the center of steel tube frame 16 embedded inside wall panels 1. Flat steel plate 14 is affixed to steel tube frame 16 using four screws 15. In one embodiment of the invention, two flat steel plates 14 are needed per panel seam to ensure that wall panels 1 can withstand the horizontal forces experienced due to wind loading.

Figure 3B:
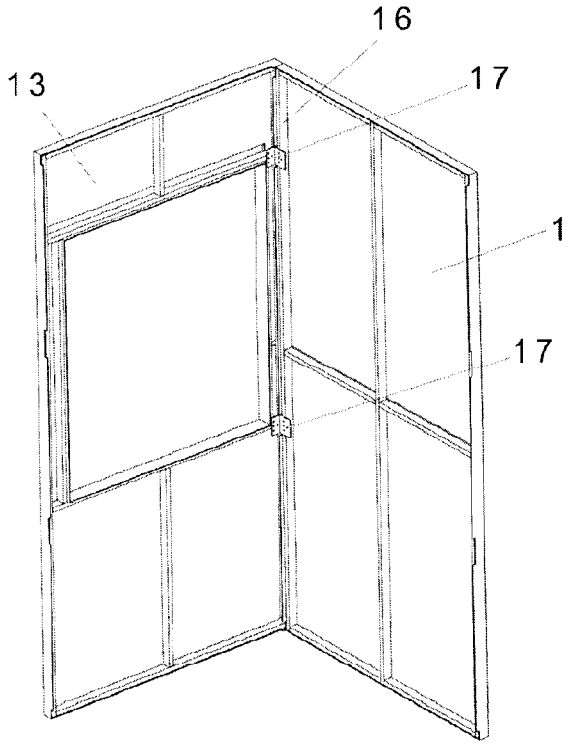
FIG. 3*b* is a perspective view of the connection detail of two perpendicular wall panels joined together at the inside corners of the dwelling of FIG. 1*a*.

FIG. 3*b* shows a wall panel 1 and a window panel 13 meeting perpendicularly at the corners of the dwelling, where flat steel plates 14 are replaced by at least one angled steel plate 17. Angled steel plate 17 has a plurality of eight holes for example to accommodate various corner mounting details, and the hole pattern is such that angled steel plate 17 can be screwed into both horizontal and vertically oriented steel tube members 16 located in the internal steel tube frame of wall panel 1 and window panel 13.

It should be understood that while panels 1 are shown with internal frame members in view, when in use panels 1 are filled with foam to provide rigidity to panels 1 and insulation to the dwelling. Panels 1 are seen in exploded view in FIG. 9.

Figure 4A:
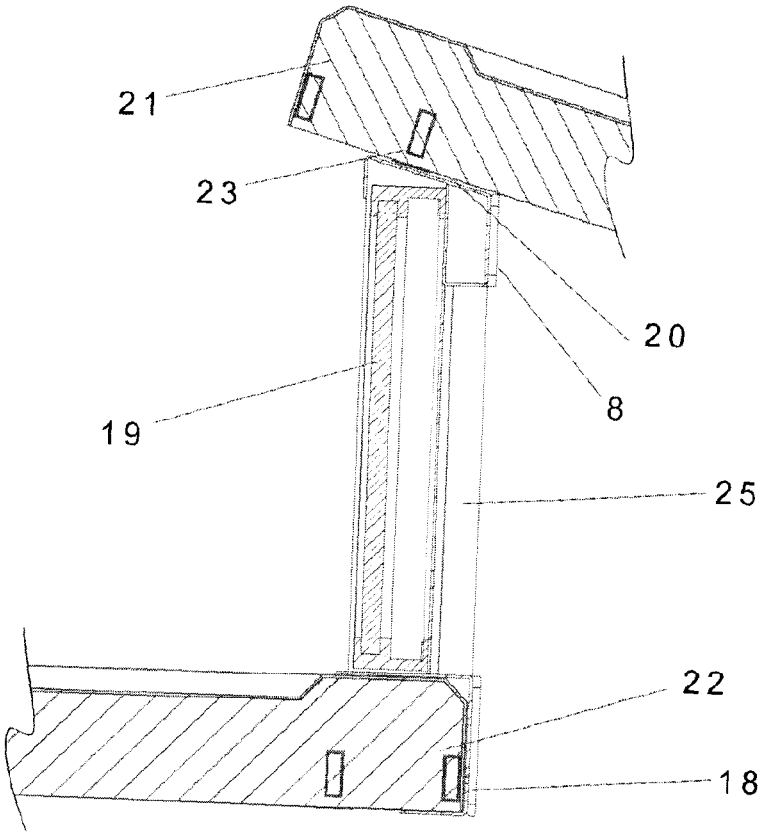
FIG. 4*a* is a cross-sectional view of a truss system and portions of roof panels which are supported by the truss system, of the dwelling of FIG. 1*a*.

FIG. 4*a* shows a cross-sectional view of truss assembly 9. Upper chord extends from one end of assembly 9 to the other at the top and lower chord extends from one end of assembly 9 to the other at the bottom in parallel alignment with upper chord. Lower chord defines a channel extending from one end of assembly 9 to the other. In this cross sectional view, inner end of flat roof panel 22 is secured into the C-section of the bottom chord of truss assembly 9 with screws placed in pre-drilled holes in the bottom chord of truss assembly 9 and its intersection with the internal steel tube frame structure of the roof panel 23. Inner end of angled roof panel 21 is secured in the same fashion using the pre-drilled holes in the top chord of truss assembly 9. Flashing 58 is positioned between the bottom of truss assembly 9 and the top of roof panel 22 to assist in the flow of rainwater from truss assembly 9 onto roof panel 22.

In one embodiment of the invention, compressive loads experienced by the top chord of the truss assembly 9 are carried into the bottom chord of the truss and towards the ends of the truss via four angled tubular supports 25. These supports 25 are welded to both the top and bottom chords of the truss assembly 9. In addition the truss assemblies 9 at each end of truss system 2 include an outer gusset plate 24 to further support those end truss assemblies 9. Only two gusset plates 24 are used for the entire truss system 2. The purpose of the gusset plates 24 is to prevent the C-section of the bottom chord of the end truss assemblies 9 from buckling under the high compressive loads the bottom chord experiences at both ends of the truss system 2 where attached to the dwelling.

Figure 4B:
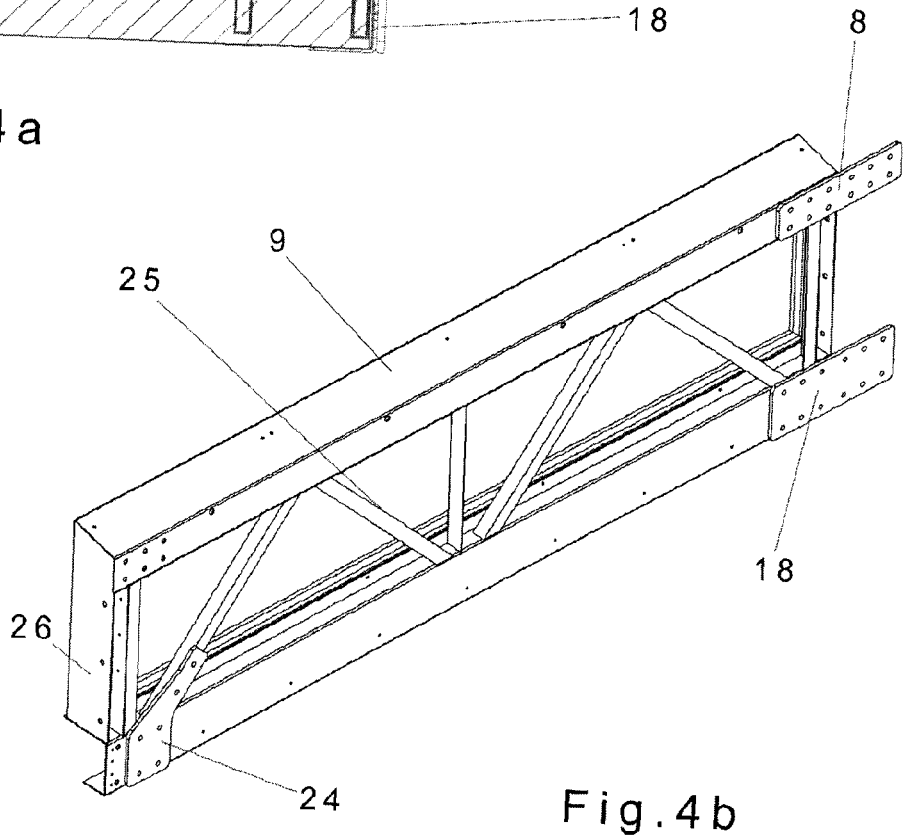
FIG. 4*b* is a perspective view of an end truss member of the four truss members that make up the truss system of the dwelling of FIG. 1*a*.

FIG. 4*b* provides a better view of the placement of gusset plate 24 at the end of the truss assembly 9. In the embodiment shown, gusset plates 24 are only installed at the outer end of each end truss assembly 9 using pre-drilled holes in the truss assembly. Gusset plate 24 and truss assembly 9 are held together using bolts for example. The four truss assemblies 9 that comprise the truss system 2 in its entirety are bolted together on site. Each truss assembly 9 is secured to an adjacent truss assembly by two steel bridge plates 8, 18. A smaller steel bridge plate 8 secures the top chords of the adjacent truss assemblies 9, and a larger steel bridge plate 18 secures the bottom chords of the adjacent truss assemblies 9. In addition to bridge plates 8 and 18, there are three additional bolts located at each joint between adjacent truss assemblies 9 to keep this joint from opening up once assembled. These three bolts are inserted through the pre-drilled holes placed in cap plates 26 welded onto the ends of each truss assembly 9.

Once the truss assemblies 9 and roof panels 21, 22 are assembled, the final assembly of installing the four window panes 19 can commence. Windows 19 are sealed from the elements with silicone or other suitable means and further secured using screws, such as four across the top of window 19, four across the bottom of window 19. Alternatively a pair of window panes 19 can run on separate tracks enabling windows 19 to be opened as desired.

Figure 5A:
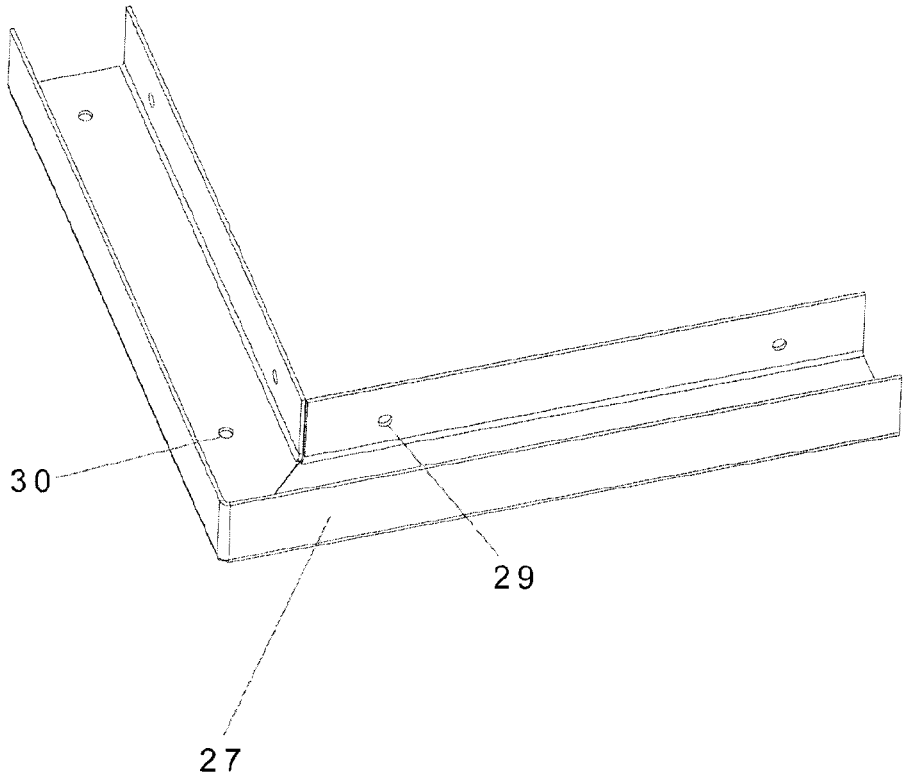
FIG. 5*a* is a perspective view of an lower corner bracket that is attached to the sub-floor at the corner of each wall section and supports two wall panels at a corner of the of the dwelling of FIG. 1*a*.
Figure 5B:
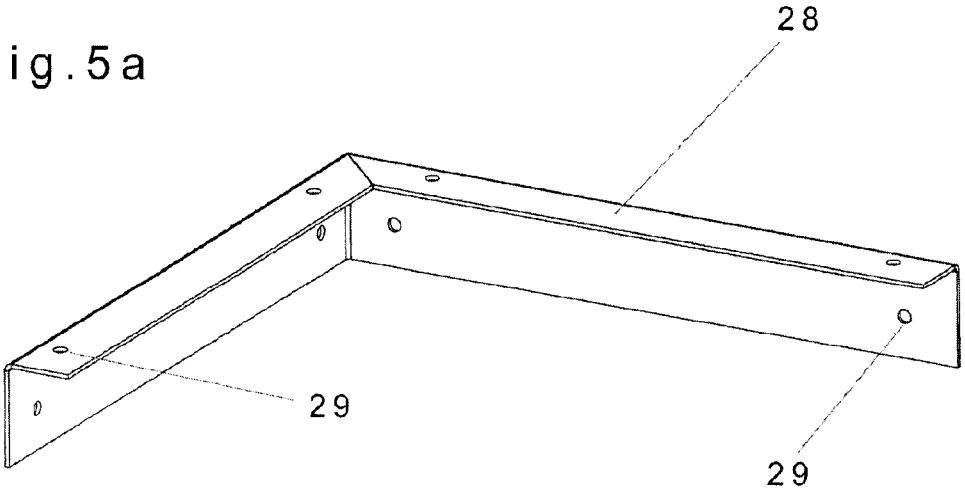
FIG. 5*b* is a perspective view of an upper corner bracket attached at the top of the wall section at a corner of the dwelling of FIG. 1*a*.

FIG. 5*a* shows fabricated steel lower corner bracket 27 that is placed at each corner of the dwelling, either onto concrete pad 33 (shown in FIG. 6) fastened with HILTI nails if the dwelling is built directly on concrete pad 33 or if on a sub-floor, with fasteners placed at the four pre-drilled hole locations 30. FIG. 5*b* shows fabricated steel upper corner bracket 28 that is also placed at each corner of the dwelling, on top of wall panels 1. The shape of the upper and lower corner brackets aids the construction crew in correctly aligning wall panels 1 with the corner of the dwelling, and makes assembly easier for a small crew. As few as two constructors are needed to install the wall panels at each corner of the dwelling.

Figure 6:
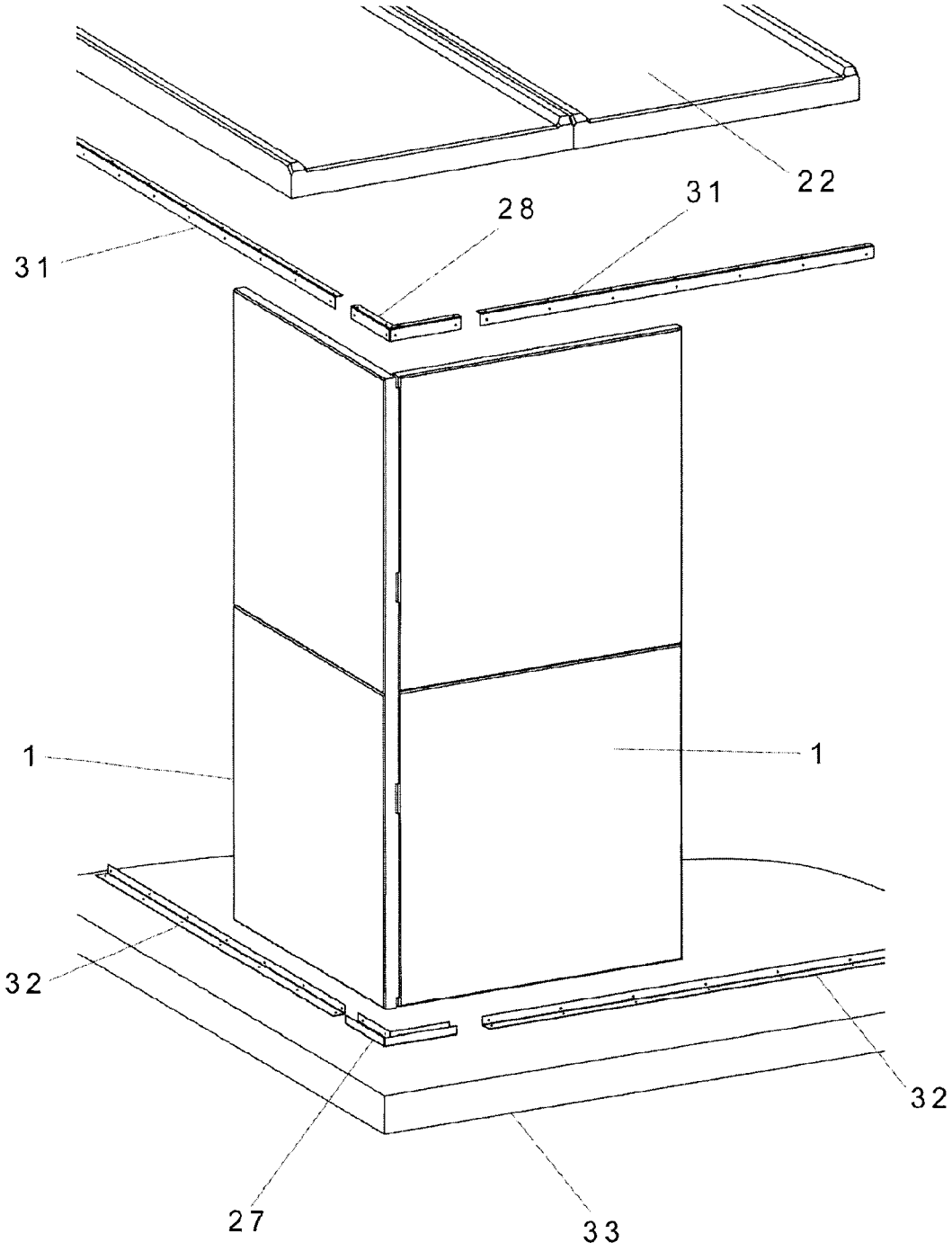
FIG. 6 is an exploded perspective view of an outside corner of the dwelling of FIG. 1*a* showing the steel brackets used to affix the wall panels to the sub-floor or concrete pad and the steel brackets used to affix the roof panels to the top of the wall panels.

As shown in FIG. 6, where wall panels 1 are not being installed at a corner of the dwelling, a straight steel bracket 32 which may measure 2.4 m for example is installed using assembly techniques similar to those described above. However, straight steel bracket 32 is "L" shaped rather than "U" shaped without an additional return on the front edge, which allows water that hits the walls of the dwelling to drain outwards towards the exterior of the dwelling rather than becoming trapped in a U-section of steel. This reduces problems inherent with wall panels 1 are sitting in a pool of water which could lead to their deterioration over time. Optionally all brackets may be "L" shaped for ease of assembly.

Figure 7:
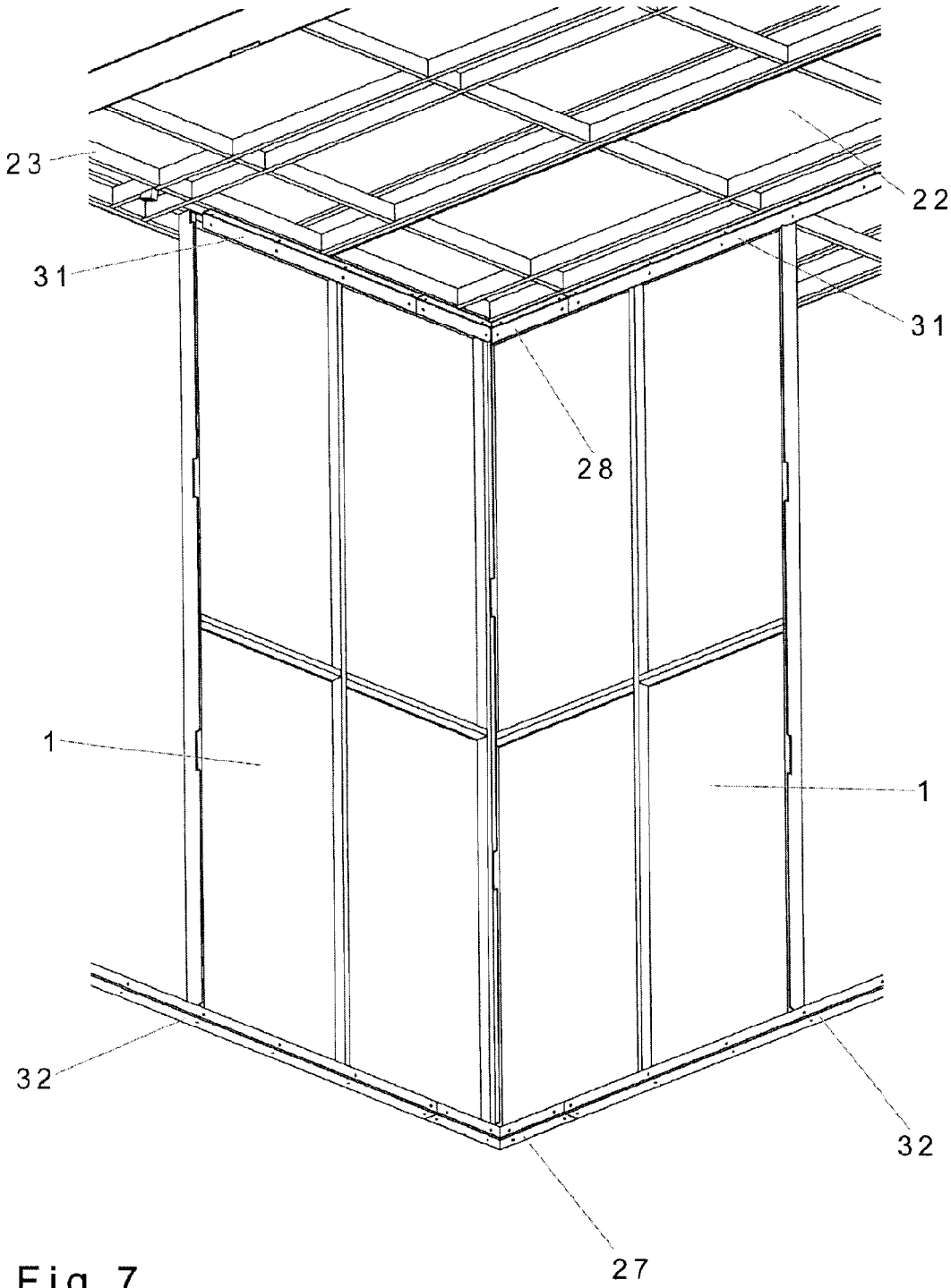
FIG. 7 is a perspective view, viewed from below of an inside corner of the dwelling of FIG. 1*a* showing the connection details between the sub-floor, wall panels and roof panels.
Figure 8A:
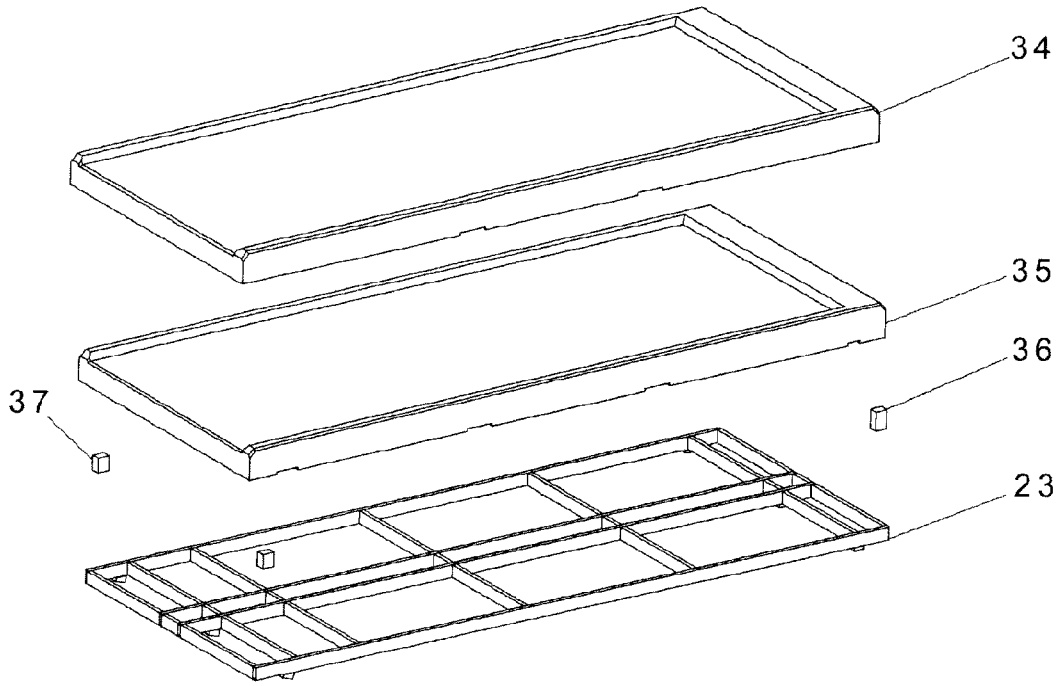
FIG. 8*a* is an exploded perspective view of a roof panel of the dwelling of FIG. 1*a*.
Figure 8B:
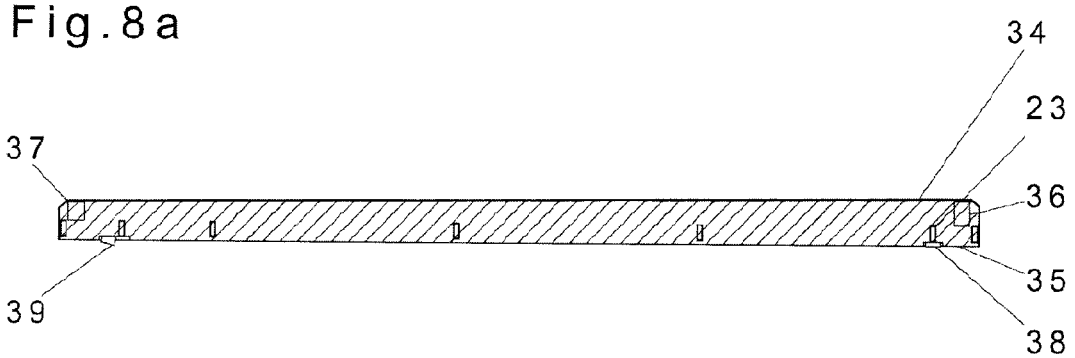
FIG. 8*b* is a cross-sectional view of a roof panel of the dwelling of FIG. 1*a*.
Figure 8C:
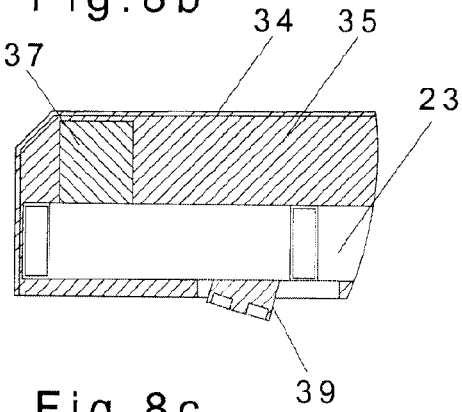
FIG. 8*c* is a cross-sectional close-up view of the thinner end of a roof panel of the dwelling of FIG. 1*a* showing its internal composition.
Figure 8D:
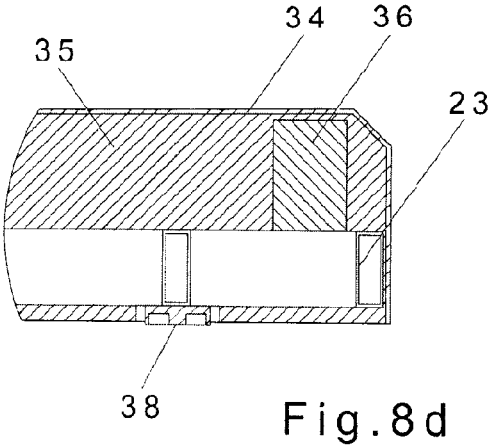
FIG. 8*d* is a cross-sectional close-up view of the thicker end of a roof panel of the dwelling of FIG. 1*a* showing its internal composition.

As shown in FIGS. 6 and 7, once brackets 27 and 32 are installed onto the sub-floor or concrete pad 33, the erection of the walls can commence. Wall panels 1 are secured to steel lower corner brackets 27 via pre-drilled holes 29 in bracket 27, and will be fastened using self drilling screws that align with the internal steel tube frame 16 that is located inside all wall panels 1. Then, as shown in FIGS. 6 and 7, steel upper corner brackets 28 are affixed to the wall panels 1 via four self drilling screws placed through the holes 29 on the vertical walls thereof. Additional four holes 29 (FIG. 5) located on the top of upper corner bracket 28 are used to secure the flat roof panel 22 to the top of the wall panels 1 by attaching the panel to the bracket using screws that intersect the tubular frame members 23 located in the roof panels (see FIG. 7). For straight sections of wall panels, bent steel brackets 31 are affixed to both the top of the wall panels 1 and the underside of the roof panels 22 to ensure a proper connection, which is needed in locations that experience high wind speeds as the roof panels can experience significant (negative) lift forces due to high speed winds flowing over the roof profile. It should be understood that while panels 1 are shown in FIG. 7 with internal frame members in view, when in use panels 1 are filled with foam to provide rigidity to panels 1 and insulation to the dwelling. Panels 1 are seen in exploded view in FIG. 9.

As shown in FIGS. 8*a*, 8*b*, 8*c* and 8*d*, the insulated composite roof panels 21 and 22 used in the construction of the modular dwelling each consist of an internal rectangular steel tube frame 23, which could be made from ¾"×2" (19 mm×50 mm) 14 gauge steel tubes for example. This frame is inserted inside a shell 34, which may be vacuum formed that is molded with the bottom side open. The frame is supported at a proper depth using blocks which may be 2 lb density STYROFOAM for example inserted into the plastic shell 34. At the thicker end of the roof panel, two blocks 36 which may be STYROFOAM for example are inserted into plastic shell 34 at the outer corners, and at the thinner end, two shorter blocks 37 which may be STYROFOAM for example are inserted into the shell at the outer corners. Frame 23 is then inserted into the shell 34 which may be plastic and rests on four blocks 36 and 37 of STYROFOAM for example. Foam 35 which is preferably of polyurethane is cast into plastic shell 34, encasing steel tube frame 23 inside polyurethane foam 35. Hence, roof panels 21 and 22 comprise a plastic shell 34 which forms a protective tough outer skin, reinforced by steel tube frame 23 and insulated by polyurethane foam 35. During casting, polyurethane foam 35 adheres to the inner surfaces of the plastic shell 34 and steel tube frame 23, creating a rigid structural roof panel.

Roof panels 22 are tapered from an inner end connectable to truss assembly 9 to an outer end connectable to the top of side walls 1 in the manner discussed above, allowing rain water and melting snow to travel away from the center of the dwelling out to a peripheral edge where it can fall off the roof outside of the dwelling's envelope. While not necessary for roof panels 21 due to their angle when assembled on the dwelling, for ease of manufacture and assembly panels 21 may also be tapered in this manner.

Plastic shell 34 is also vacuum-formed with a ridge along 3 sides of roof panels 21 and 22. Ridges are positioned along both longitudinal edges of roof panels 21 and 22 including where roof panels 21 and 22 abut adjacent roof panels 21 and 22. These ridges help to direct water away from the seams between the roof panels towards the centre of the panel, which aids in directing the water toward the outer edge of the panel where it can either be captured using a gutter system or allowed to fall onto grade outside of the buildings envelope. A cap (not shown) can be positioned above the seam between panels. A third ridge is positioned at the inner thicker end of roof panels 21 and 22 to further facilitate the exiting of water from the inner ends of roof panels 21 and 22 adjacent truss assemblies 9.

Six rigid blocks 38 and 39 which can be of PVC plastic are attached to the underside of roof panels 21 and 22 prior to installation. Plastic blocks 38 and 39 support the weight of roof panels 21 and 22 and eliminate compression of the polyurethane foam 35 that might occur due to heavy roof loads. In order to install the six plastic blocks 38 and 39, the ½" (13 mm) of polyurethane foam 35 that covers steel frame 23 is removed in six corresponding locations exposing the steel frame. Plastic blocks 38 and 39 are then attached to the steel frame via screws, or other suitable means such as by gluing, that support them in place. Blocks 38 have a flat profile and rest either directly on the top edge of the wall panels 1 or on the top edge of the truss assembly 9. Plastic blocks 39 have a fifteen degree incline and are placed on the underside of the inclined roof panel where they rest on the top edge of the wall panel 1. This ensures that polyurethane foam 35 is not crushed due to loads experienced by roof panels 21 and 22.

As shown in FIGS. 9*a*, 9*b* and 9*c*, the insulated composite wall panels 1 used in the construction of the modular dwelling each consist of an internal rectangular steel tube frame 16, made from steel tubes. This frame is inserted inside a shell 40 which may be vacuum formed that is molded with the back side open. The frame is supported at the proper depth using blocks 42 which may be 2 pound density STYROFOAM inserted into the plastic shell 40. Four foam blocks 42 are placed inside the shell 40 in the outer corners. Frame 16 is then inserted into plastic shell 40, and rests on the four blocks 42. Foam 41 preferably polyurethane is cast into plastic shell 40, encasing steel tube frame 16 inside polyurethane foam 41. Hence, wall panels 1 comprise a plastic shell 40 which forms a protective tough outer skin, reinforced by steel tube frame 16 and insulated by polyurethane foam 41. During casting, polyurethane foam 41 adheres to the inner surfaces of plastic shell 40 and steel tube frame 16, creating a rigid structural wall panel capable of protecting the dwelling from the outdoor elements and insulating it from fluctuations in outdoor temperature. The lack of organic materials used in the construction of the wall panels ensures that they will not break down over time with exposure to moisture and other factors that typically attack organic materials used in construction.

Figure 10:
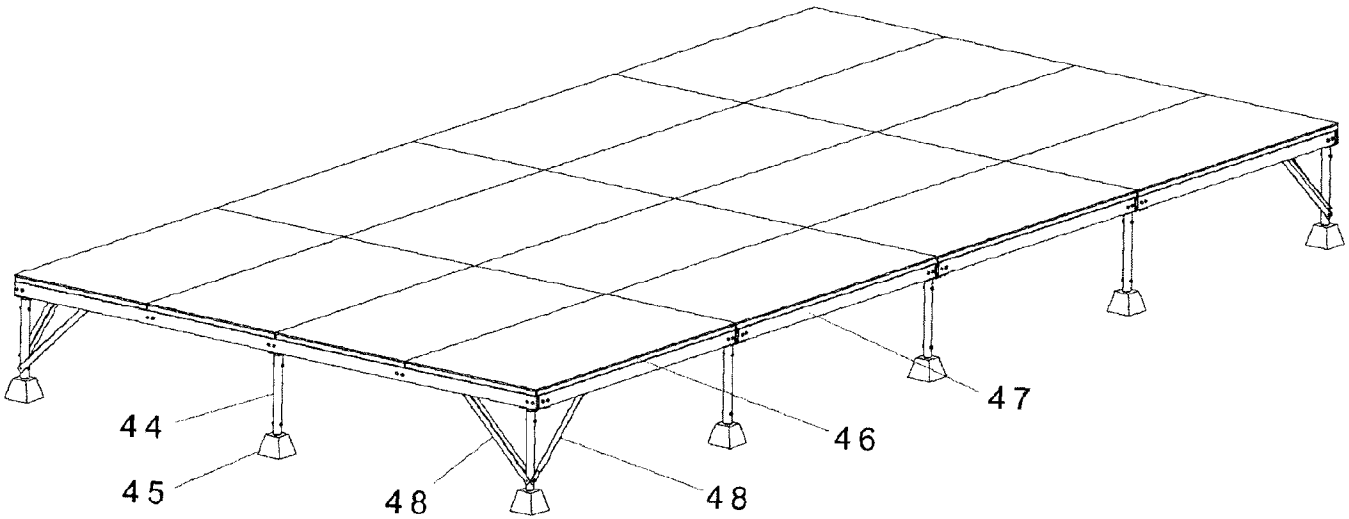
FIG. 10 is a perspective view of the post foundation and sub-floor system in accordance with an alternate embodiment of the invention.

As shown in FIG. 10, the foundation for the dwelling consists of adjustable hollow steel posts 44 that are cut to length depending on the topography of the building site. In one embodiment, posts 44 are supported on soil using concrete feet 45 of which fifteen are placed at intersecting joints where two board panels 46, which can be "hardie boards", meet. Panels 46 are supported on top of composite floor panels 49 (FIG. 11) that have almost the identical composite construction as the wall panels 1 shown in FIG. 9*a*. Floor panels 49, which may for example be 1200 mm wide×2400 mm long and supported by a grid of structural C-channels 47 that are bolted together into a rigid grid onsite. The C-channel grid is then further bolted onto plates that support the joint locations and carry the loads into the vertical posts 44.

Figure 11A:
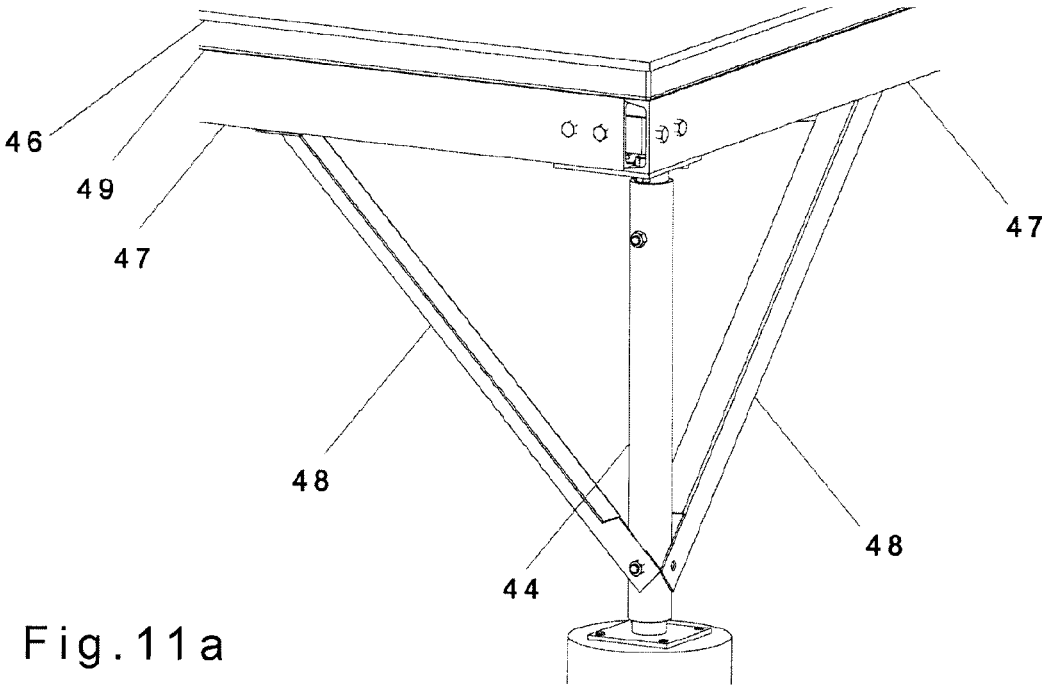
FIG. 11*a* is a perspective view of one of the four corners of the post foundation and sub-floor system of FIG. 10.

In the embodiment shown in FIG. 11*a*, the four outer corners of the dwelling foundation are supported by vertical posts 44 that are attached to poured concrete footings 45 by, for example, four HILTI nails. Each post 44 is additionally supported against 'racking' via two angular brackets 48 bolted to the base of each post and attached at the top to the bottom side of C-channels 47. Above that is composite floor panel 49 which is covered with board panel 46 which can be ⅜" hardie board for wear and weight distribution across composite panel 49.

Figure 11B:
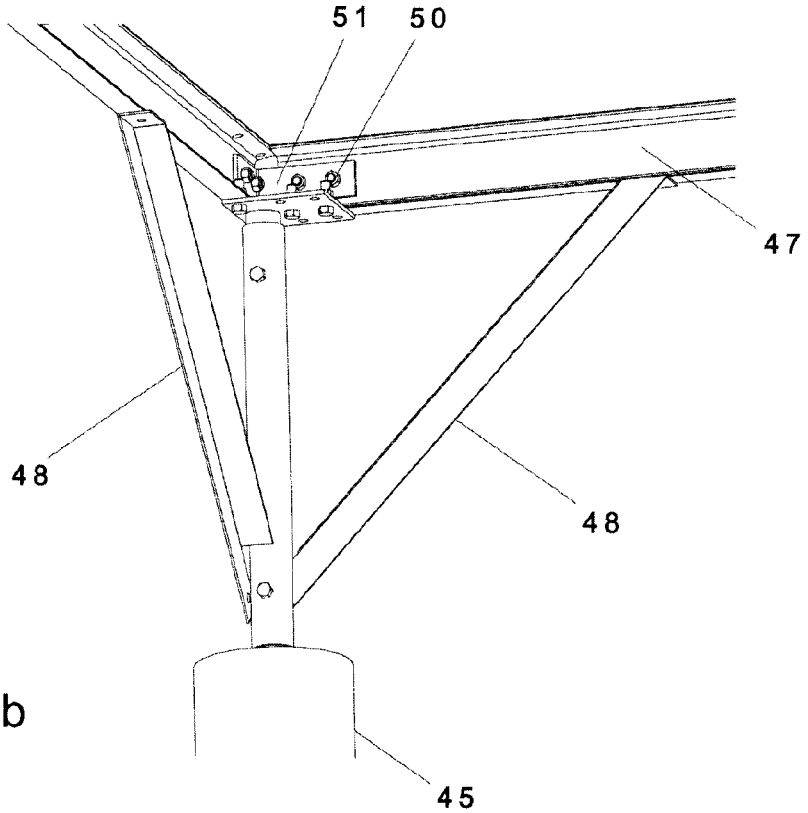
FIG. 11*b* is a perspective inner view, viewed from below, of a corner of the post foundation and sub-floor system of FIG. 10.
Figure 13A:
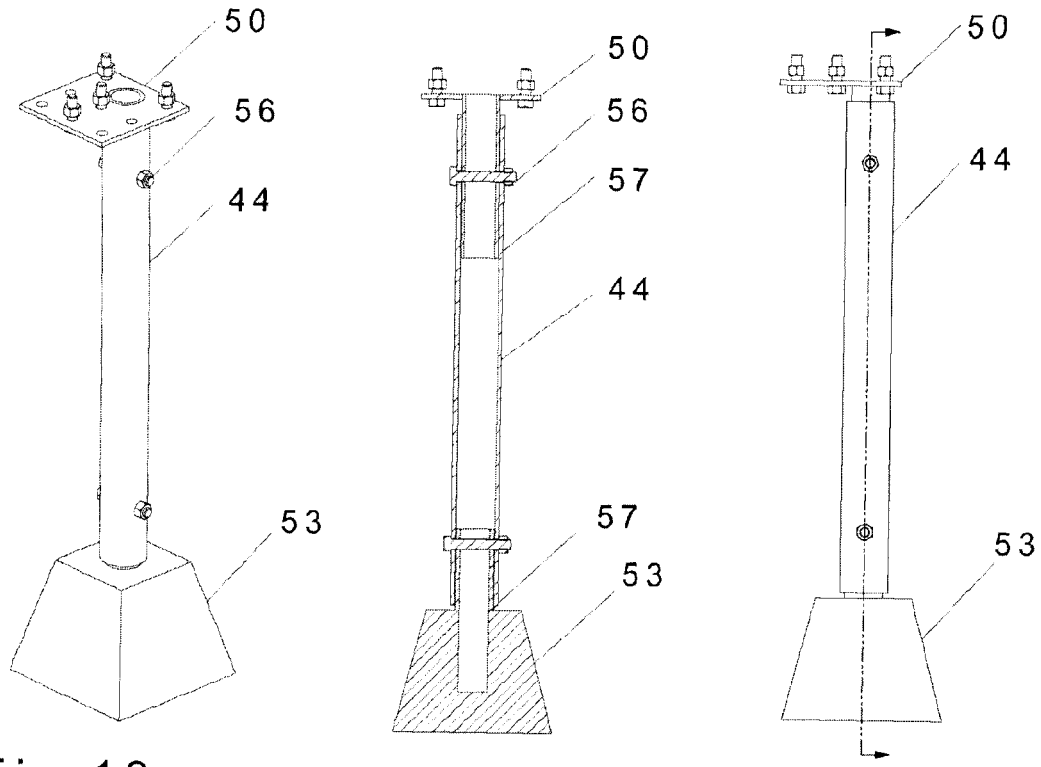
FIG. 13*a* are perspective, cross-sectional and plan views of a typical foundation post of the post foundation and sub-floor system of FIG. 10.

In the embodiment shown in FIG. 11*b*, the top of post 44 has a top plate 50 that slides onto post 44 and is bolted thereto using bolts 56 (shown in FIG. 13*a*). Holes in post 44 may be drilled on site once the height of the post is determined, and the lengths may be custom cut depending on the height of the footing 45 relative to the sub-floor. This 'adjustable' post length allows the sub-floor to remain level even if the topography of the building site is not. Top plate 50 bolts to the underside of C-channels 47. These C-channels are bolted to each other at each intersection point using angle bracket 51.

Figure 12A:
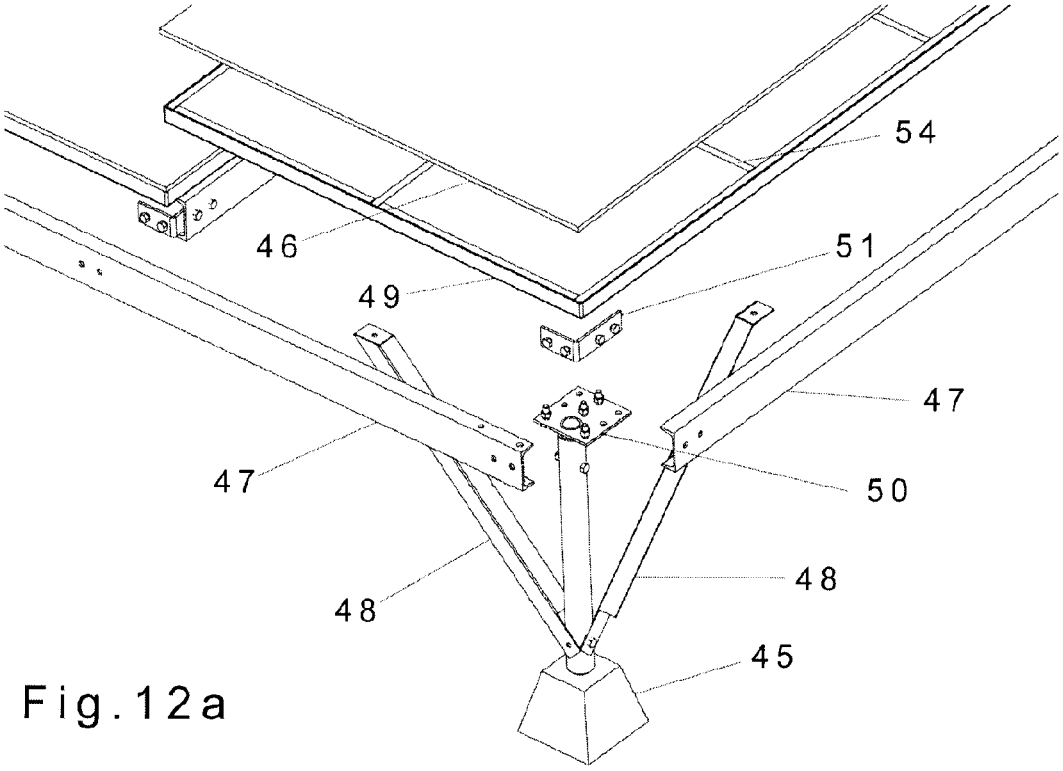
FIG. 12*a* is an exploded perspective view of a corner of the post foundation and sub-floor system of FIG. 10.
Figure 12B:
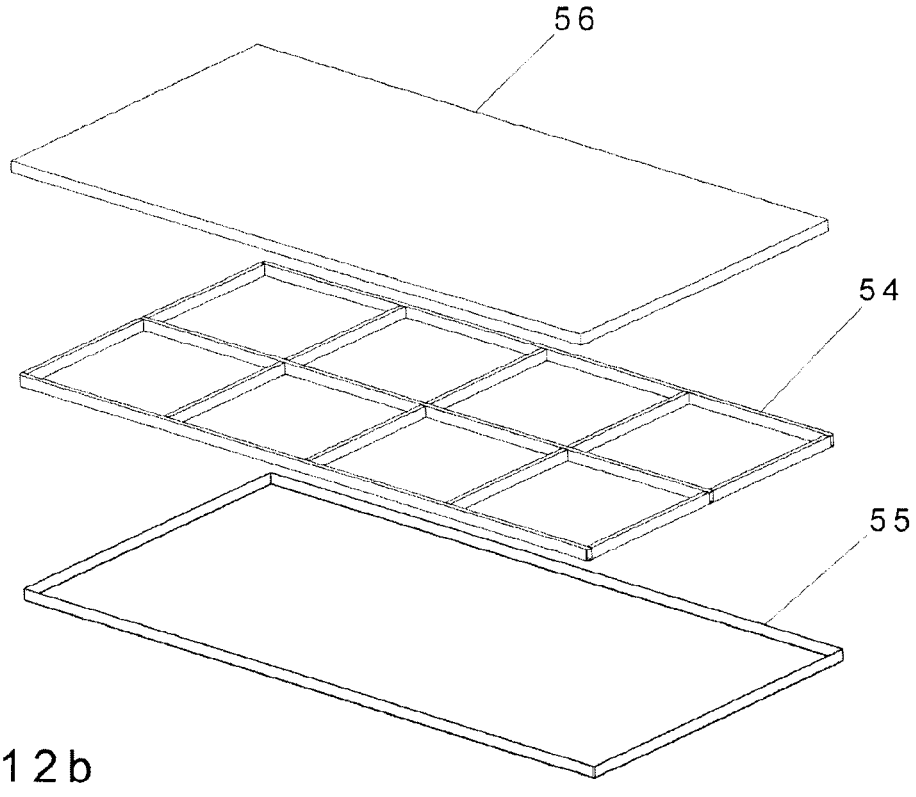
FIG. 12*b* is an exploded perspective view of the insulated floor panels of the post foundation and sub-floor system of FIG. 10.

FIG. 12*a* shows in greater detail the components used at each corner connection of the dwelling floor, while FIG. 12*b* shows the components of the composite floor panel 49. Steel frame 54, which forms the structural support for composite floor panel 49, is shown in FIGS. 12*a* and 12*b*. As shown in FIGS. 12*a* and 12*b*, steel frame 54 may be flush with polyurethane foam and board panel 46 is supported on top of composite floor panel 49 with steel frame 54. As shown in FIG. 12*b*, shell 55 of composite floor panel 49 faces down to protect the internal components thereof, namely polyurethane foam 56 and steel frame 54 from outside elements.

The vertical support post assembly shown in FIG. 13*a* is placed at all grid intersection points (see FIG. 10 but also at internal intersecting points) and consists of a vertical post 44 that slides over a pipe 57 embedded in a concrete footing 53 and bolted with a bolt 56. Top plate 50 is also welded onto pipe 57 that slides inside post 44 and is also bolted with a bolt 56. Top plate 50 may have multiple hole locations that allow it to be mounted in either a left justified, right justified or centre location.

Figure 13B:
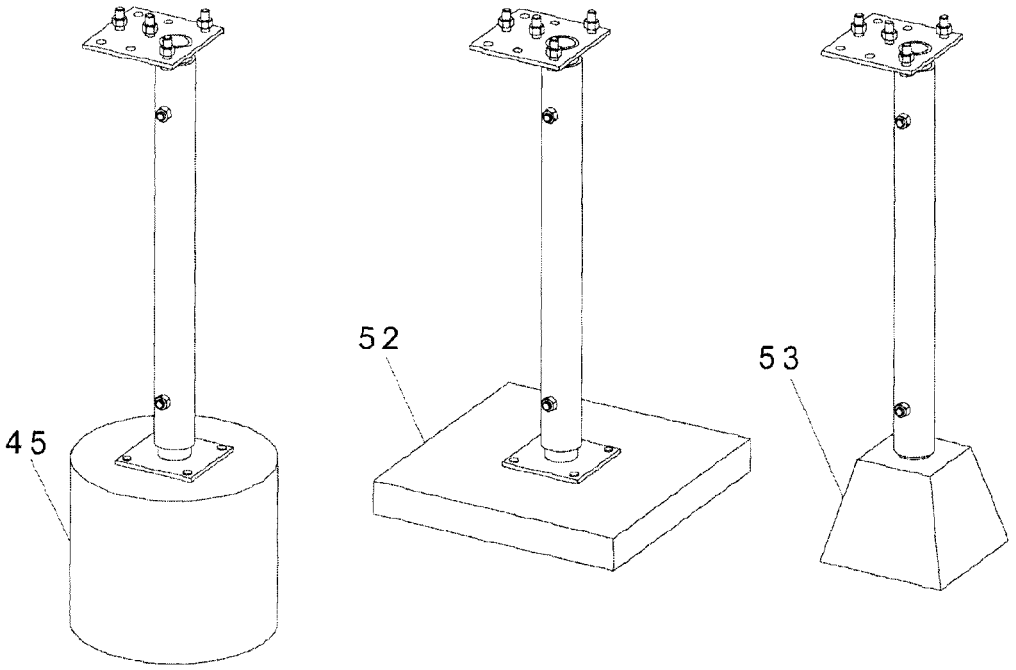
FIG. 13*b* are perspective views of three alternate embodiments of foundation post footings of the post foundation and sub-floor system of FIG. 10.

FIG. 13*b* describes multiple embodiments for footing technology that can be adapted depending on the density of the soil on grade. Poured concrete footing 45 is created by either installing sono-tubes and filling them with concrete, or by digging a hole in the grade using a dost hole digger and filling the hole with concrete and allowing it to cure. For softer grades, such as on sand, fine gravel, or soft soil, larger concrete tiles 52 can be laid on grade and the posts can be nailed with HILTI nails directly to the sub-floor or concrete pad via an additional steel plate welded to a pipe (not shown). Concrete tiles 52 can be backfilled with soil to help maintain their location and disguise the footing under the landscaping. Another embodiment for use with stable sites is a smaller hybrid footing 53 that consists of a steel pipe pre-cast into a concrete footing. These are relatively fast to install as they only need to be bolted to post 44. However, footing 53 provides no negative or lateral support in the case of high lift forces that could be experienced in areas subject to hurricane force winds. They only rely on the mass of the dwelling to keep the dwelling location fixed in place.

Alternate Embodiments

Figure 14A:
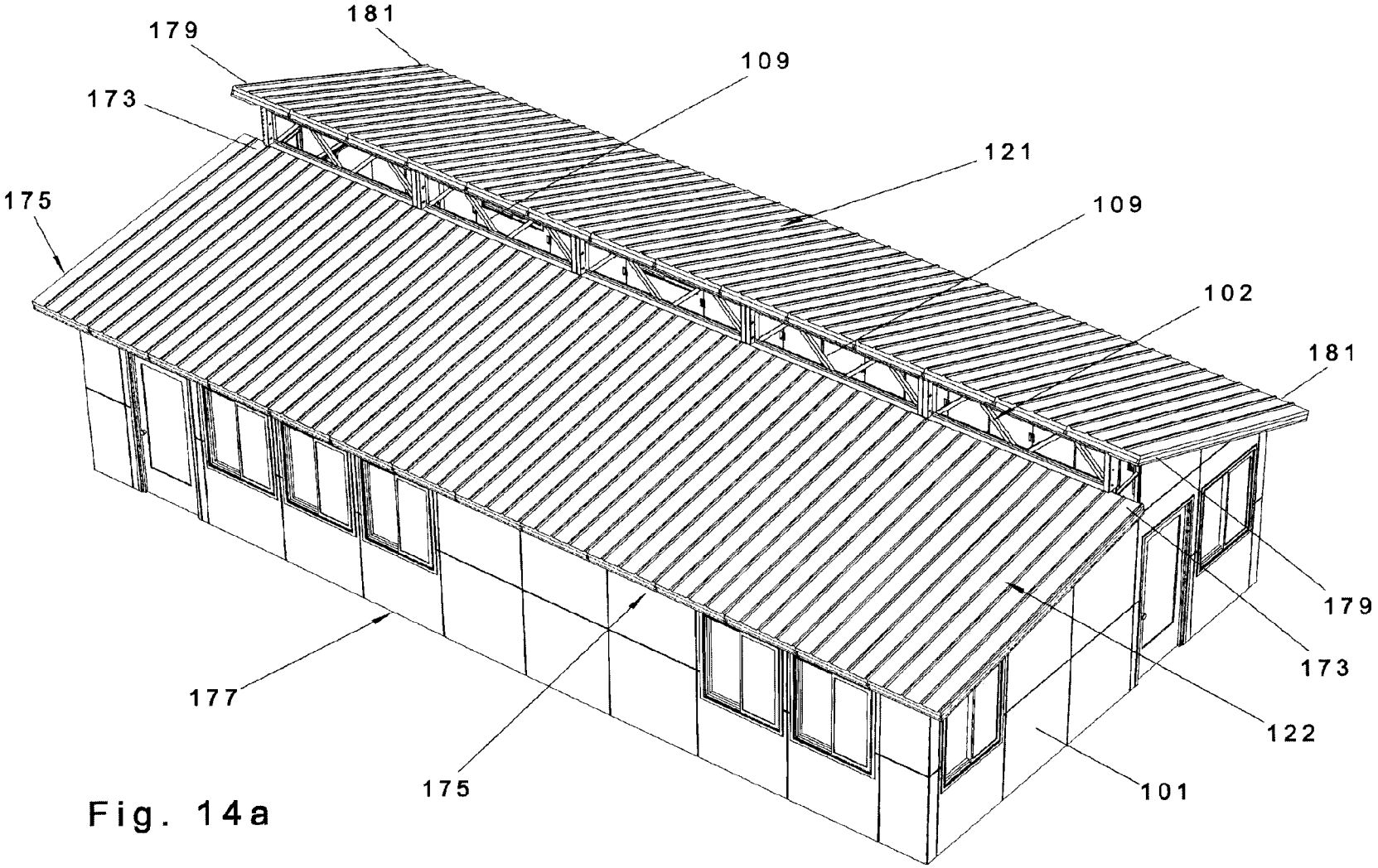
FIG. 14*a* is a perspective view, viewed from above, of an assembled modular dwelling in accordance with another embodiment of the invention.

Another embodiment of the invention is shown in FIG. 14*a* depicting an assembled modular dwelling. Wall members 101 (sometimes called wall members) are bolted together around the periphery of concrete pad 33 (shown in FIG. 6) to create walls with a co-planar upper periphery which act as vertical structural elements and insular elements of the dwelling. A modular truss system 102 is comprised of five truss members 109 (one shown in FIG. 17*b*) which span the length of the dwelling. Although other numbers of truss member 109 are also contemplated. A pair of composite roof panel assemblies, namely a steeper angled roof panel assembly 121 and a less steep angled roof panel assembly 122, made up of a series of connected panels, cover the dwelling.

Each truss member 109 accommodates a rectangular double glass pane window 119 that acts as a thermal barrier to the outside elements and provides a method for ambient light to flood the inside of the dwelling, thereby decreasing the need for additional incandescent or fluorescent light sources. Optionally the window may be single pane or opaque panels and windows may be placed in alternate truss assemblies 109 or otherwise mixed.

In an embodiment of the invention less steep angled composite roof panels 122 may measure 0.9 m×3.6 m for example and steeper angled composite roof panels 121 may measure 0.9 m×3.6 m for example although other sizes are also possible. As well, truss system 102 may be 12 m in length and 0.6 m in height, and can be made entirely of steel. A double glass pane window 119 may be of dimensions 2.4 m×0.6 m for example.

The modular dwelling depicted in FIG. 14*a* includes a plurality of wall members 101 attached together to enclose the interior of the modular dwelling. Truss system 102 made up of end to end aligned truss members 109 extend across the dwelling supported at each end by a vertical post 110, 111. Truss system 102 is positioned horizontally with lower chord 165 connected to upper chord 167 by a series of cross brace members 125 (FIG. 14*b*).

Figure 15A:
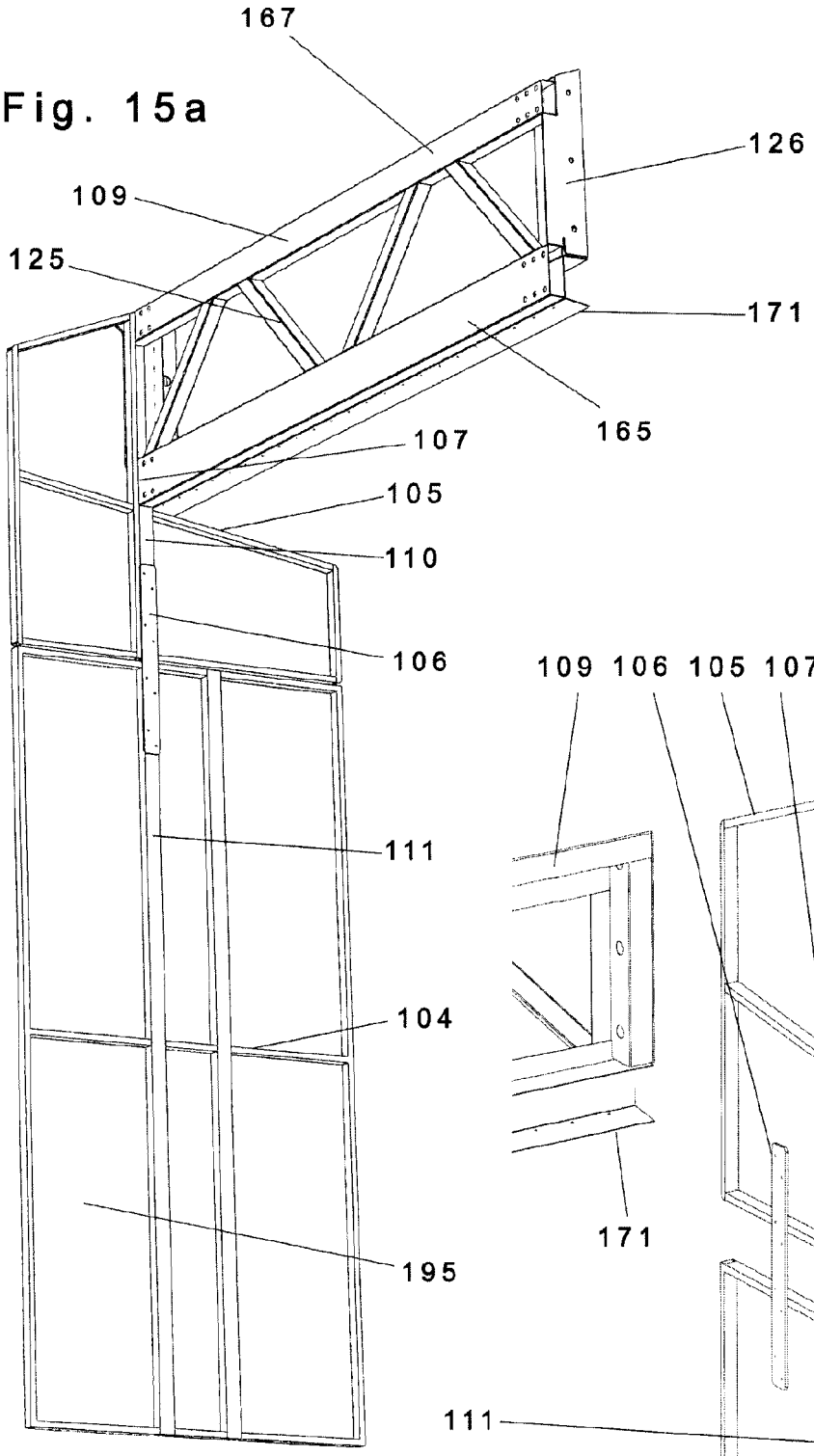
FIG. 15*a* is a perspective view, viewed from below of the center end wall panel and the gable end panel that contains the posts that support ends of the truss system, of the dwelling of FIG. 14*a*.
Figure 15B:
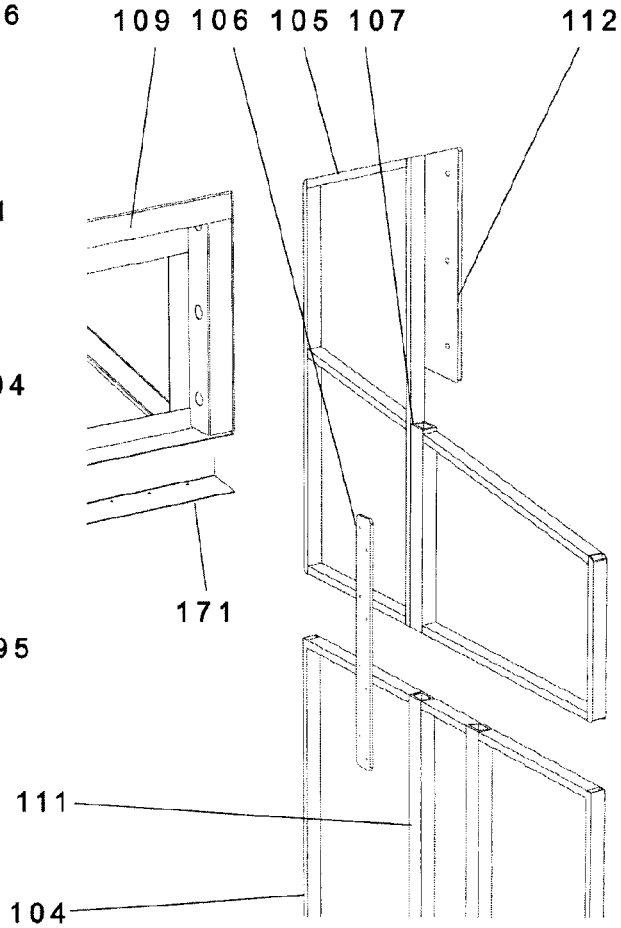
FIG. 15*b* is an exploded perspective view of one of the gable ends showing the steel framework supporting the end of the truss system, of the dwelling of FIG. 14*a*.

Lower chord 165 includes support 171 seen best in FIGS. 15 and 17. Less steep angled roof panel assembly 122, sometimes referred to herein as lower roof member, includes first end 173 supported by support 171. Less steep angled roof panel assembly 122 also includes second end region 175 opposite first end 173. Second end region 175 is supported by first wall section 177.

Figure 14B:
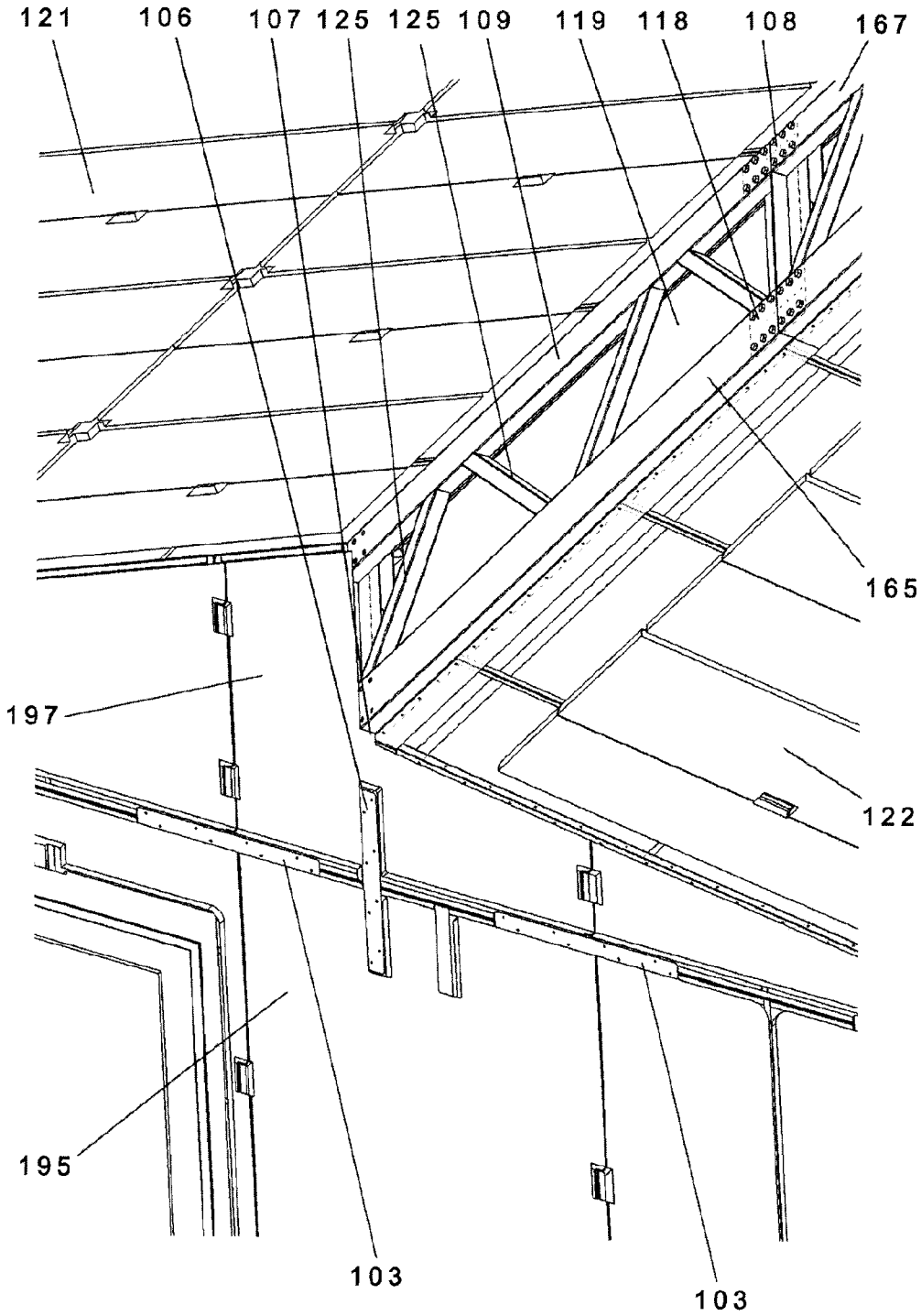
FIG. 14*b* is a perspective view, viewed from below, of an inner region of the dwelling of FIG. 14*a* with the sub-floor removed showing the steel bracket details of one of the end walls including horizontal beams and vertical posts supporting the end of the truss system.

Steeper angled roof panel assembly 121, sometimes referred to herein as upper roof member includes first end 179 supported by upper chord 167 (FIG. 14*b*). The steeper angled roof panel assembly 121 also includes second end region 181 opposite first end 179. Second end region 181 is supported by a second wall section (not shown) along the opposite wall of the dwelling from first wall section 177.

Figure 17A:
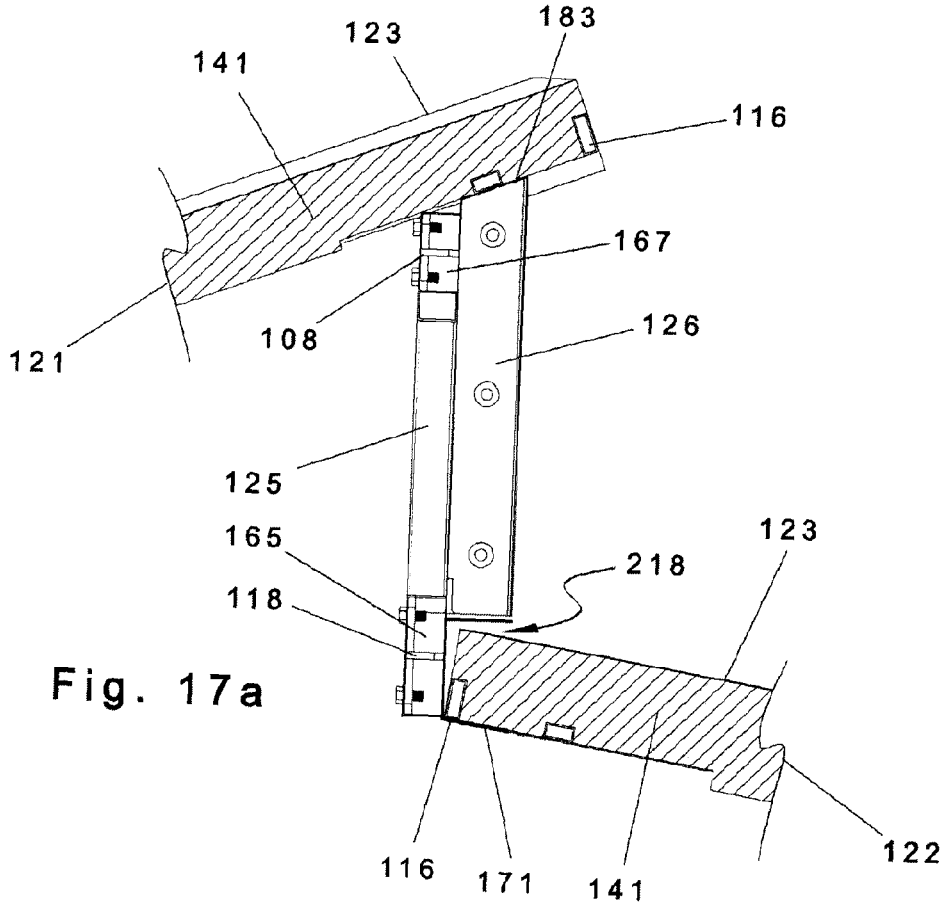
FIG. 17*a* is a cross-sectional view of a truss system and portions of roof panels which are supported by the truss system, of the dwelling of FIG. 14*a*.
Figure 18A:
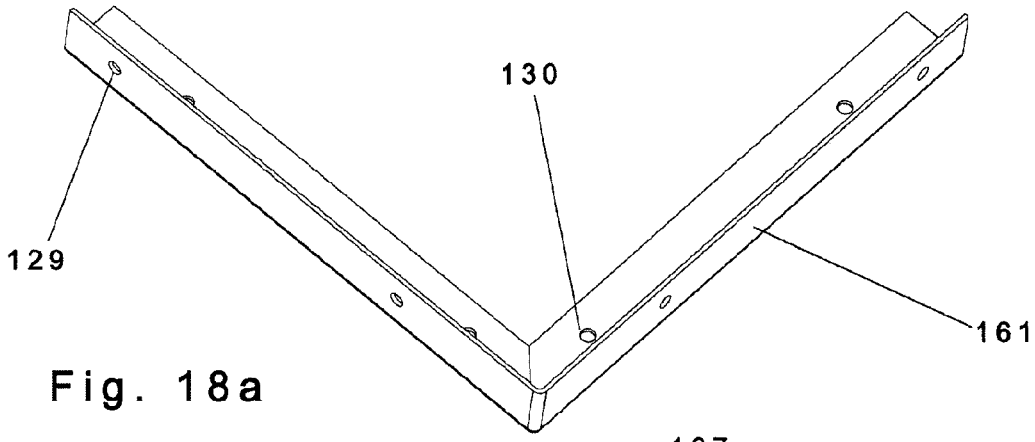
FIG. 18*a* is a perspective view of an lower corner bracket that is attached to the sub-floor at the corner of each wall section and supports two wall panels at a corner of the of the dwelling of FIG. 14*a*.
Figure 18B:
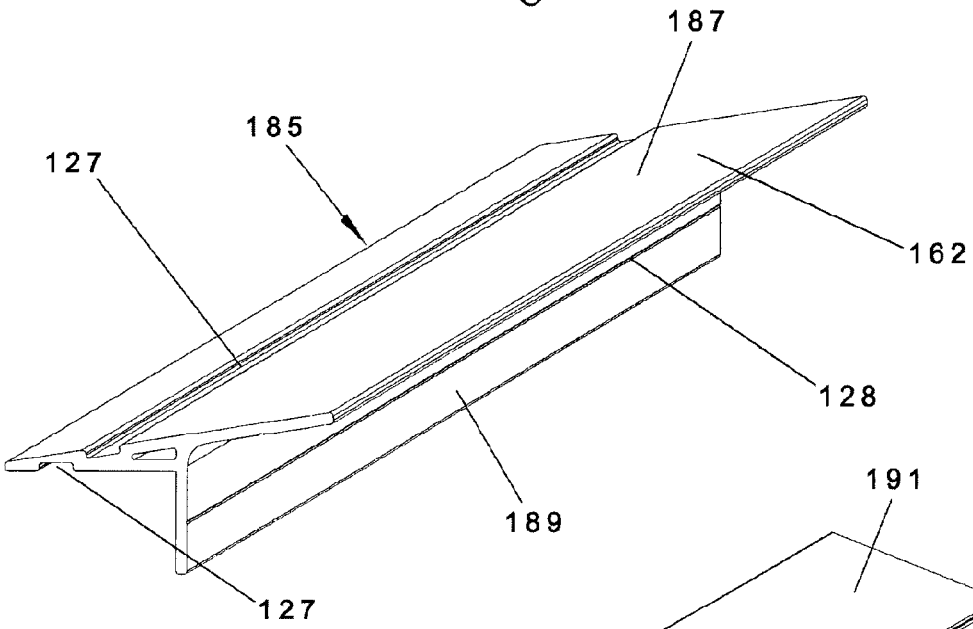
FIG. 18*b* is a perspective view of an upper extrusion bracket attached at the top of the wall section where the steeper pitched roof meets a wall of the dwelling of FIG. 14*a*.
Figure 18C:
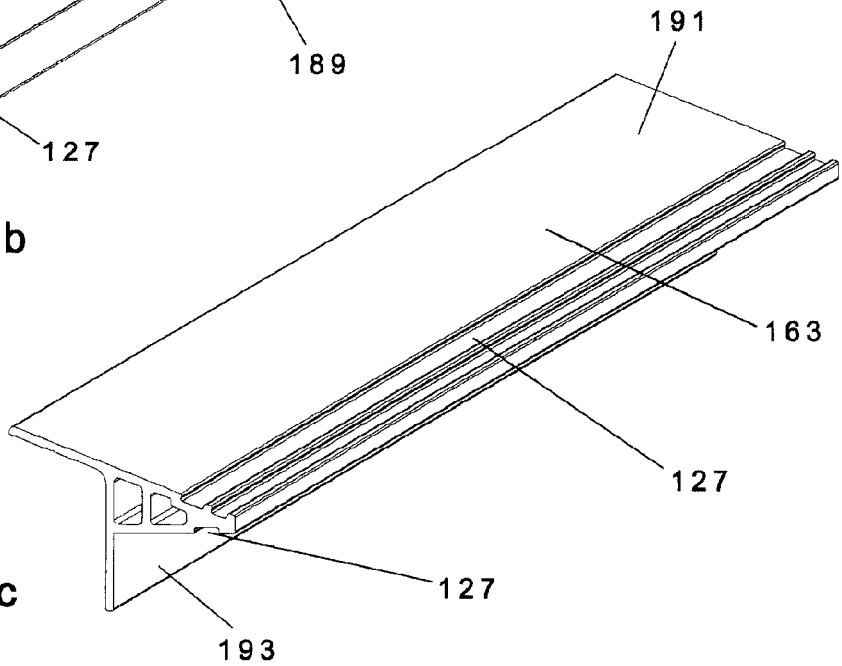
FIG. 18*c* is a perspective view of an upper extrusion bracket attached at the top of the wall section where the less steep pitched roof meets a wall of the dwelling of FIG. 14*a*.

As seen best in FIGS. 17*a*, 18*b* and 18*c*, upper surface 183 is angled in co-planar alignment in an upper roof plane extending downwardly from upper surface 183 to upper surface 162 of the second wall section. In this embodiment angled tubular support 162 is attached to the upper end of second wall section with the angle between upper surface 187 of bracket 162 is positioned at an angle with respect to lower flange 189 such that when flange 189 is attached to a vertical surface of the second wall section the plane defined by surface 187 intersects with the plane defined by upper surface 183 of truss system 102.

Similarly, and in addition, support 171 and the upper surface of the first wall section are angled in co-planar alignment in a lower roof plane extending downwardly from support 171 to the upper surface of the second wall section. Referring to FIG. 18*c*, bracket 163 includes upper surface 191 connected to vertical lower flange 193 at an angle such that when flange 193 is attached to a vertical surface of first wall section 177 surface 191 defines a lower roof plane in co-planar alignment with the plane defined by support 171. In this way, surface 191 and support 171 are angled in co-planar alignment in the lower roof plane extending downwardly from support 171 to surface 191. Less steep angled roof panel assembly 122 rests on and is supported by support 171 and bracket 163.

FIG. 14*b* is a view from the interior of the dwelling, looking upwards. End truss member 109 is partially supported at its end on the top of post (hidden from view) at point 107 embedded in the adjacent gable end panels 197. However, the load of the truss 109, roof panels 121 and 122 and any additional snow loads in winter necessitate the need for upper post 110 and lower post 111 to also support this load. Post 111, seen best in FIG. 15, is located at each end of the truss system 102 and is positioned directly under the bottom of the corresponding end truss assemblies 109. Post 111 is embedded inside the framework 104 of the center wall panel 195. The center gable end panel 197 is positioned on top of the center wall panel 195 and the compressive loads of truss assembly 102 are supported at point 107 on the top of post 110. Post 110 is in-line with post 111 and is secured and bolted to post 111 with a binding plate 106.

It should be understood that under some applications, including those expected to endure heavier wind or snow load more than one plate 106 may be required to adequately reinforce wall panels 195 and 197. Additional plates 103 may also be required or other profile such as tubing to add to the reinforcement of the dwelling.

In addition to binding plate 106, FIG. 14*b* also shows the location of binding plates 103, which are shown in a horizontal position, although vertical positioning is also possible. Five binding plates 103 tie together the bottom of the gable end panels that are inserted in the gable end to fill the gap created by the angling of roof panel assemblies 121 and 122 and the top of the two opposite sets of wall members 101 below each gable end. Binding plate 106 and plates 103 are affixed to system 102 the frames 104 and 105 (FIG. 15*a*) with eight bolts each.

It should be understood that other known means and numbers for fastening components together can be employed throughout this description, in addition to bolts, such for example as screws or welds.

The ends of the entire truss system 102 are carried in compression on the top of post 110 and are further fixed in place with three bolts at each end which ties together the two adjacent plates 126 (FIG. 17*b*) and 112 (FIG. 15*a*). Plate 112 is part of frame 105 which comprises the frame of the center gable end panel 197 and plate 126 is part of the truss member 109. The three holes in plate 126 are also used to secure each truss member 109 to an adjacent truss member 109.

However the main connecting members are bridge plates 108 and 118 that connect the upper and lower chords 167, 165 of the truss members 109 to one another. Bridge plates 108 and 118 are inserted into the open ends of chords 167 and 165 and secured to the chords via screws bolted to plate 112 from the outside. This allows for a cleaner joining between truss members 109. Once all five 2.4 m truss members 109 are bolted together using bridge plates 108 and 118 the sections will comprise a single 12 m long truss system 102. Because of the modularity of the truss members 109, the overall truss system 102 and the length of the overall dwelling can be shortened or lengthened in 2.4 m increments depending on the number of truss members 109 used. Other increments are also possible, such as 1.2 meter segment lengths.

Figure 16A:
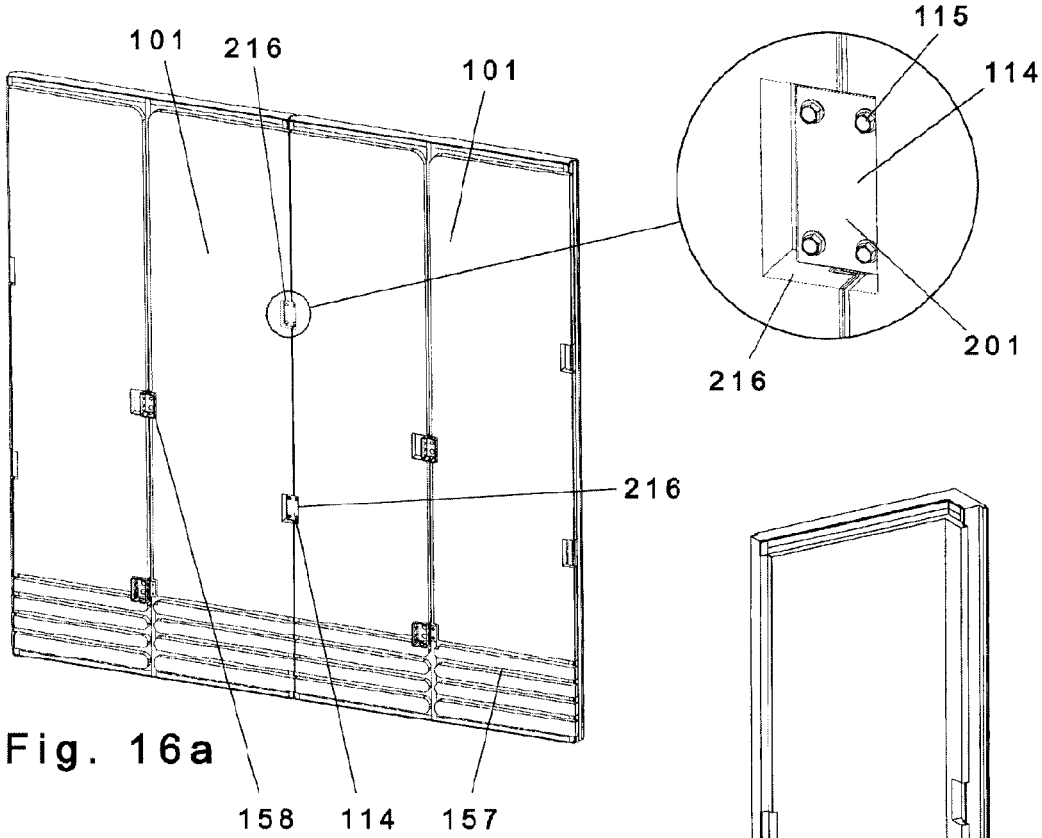
FIG. 16*a* is a perspective view, and a close-up view, of the connection detail of two wall panels joined together with two steel plate brackets, of the dwelling of FIG. 14*a*.
Figure 22A:
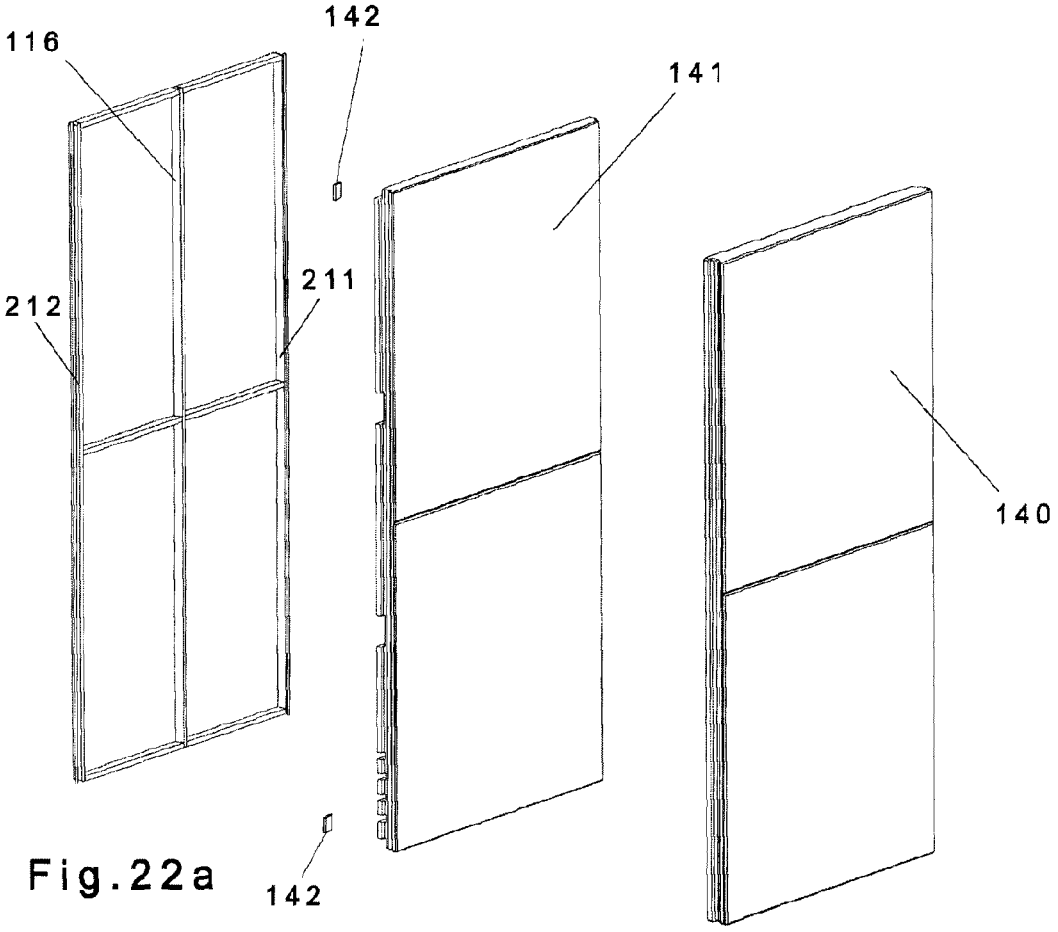
FIG. 22*a* is an exploded perspective view of a wall panel of the dwelling of FIG. 14*a*.
Figure 22B:
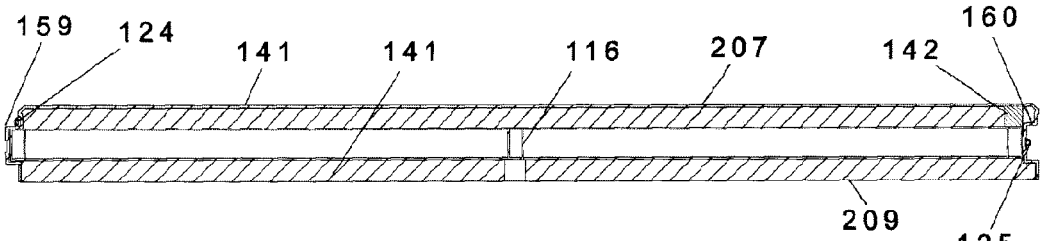
FIG. 22*b* is a cross-sectional view of a wall panel of the dwelling of FIG. 14*a*.
Figure 22C:
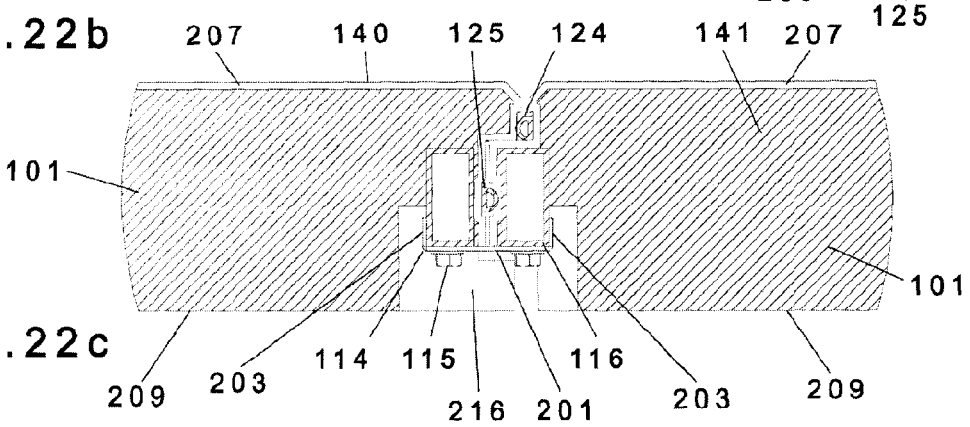
FIG. 22*c* is a cross-sectional close-up view of connecting portions of two adjacent wall panels of the dwelling of FIG. 14*a*.

FIGS. 16*a* and 22*c* show wall member 101 joined to an adjacent wall member 101 by at least one bent steel plate 114. Four holes in base member bent steel plate 114 line up with the center of steel tube frame 116 embedded inside wall members 101.

Bent steel plate 114 is affixed to steel tube frame 116 using four screws 115, the bent, tapered flanges 203 of the plate 114 secure the steel tube frames 116 of two adjacent panels 101 together.

When securing two adjacent panels 101 together the tongue 159 and groove 160 of the adjacent panels 101 ensures proper alignment of panels 101 and acts as a barrier against water and wind penetration. Bent plate 114 with its tapered flanges 203 is dimensioned to tightly secure tongue 159 of a panel 101 into groove 160 of an adjacent panel 101. Outer rubber gasket 124 and inner rubber gasket 125 ensure that any unevenness between the sealing surfaces is accommodated by the flexibility of the rubber gaskets 124 and 125. The rubber gaskets 124 and 125 and tongue 159 and groove 160 obviate the need for any additional sealants to be applied to vertical joints between panels 101. Although sealant could be applied, if desired, for additional water and wind tightness. In one embodiment of the invention, two bent steel plates 114 are needed per panel joint to ensure that wall members 101 can withstand the horizontal forces experienced due to wind loading.

As seen best in FIG. 22*c*, a pair of wall members 101 are joined in side-by-side attachment to each other. Each of the wall members 101 include an outer side 207, an inner side 209 and first and second end members 211 and 212 seen best in FIG. 22*a*. First end member 211 includes an outer extension or tongue 159. The second end member includes groove 160 for mating with extension or tongue 159. When the wall members 101 are joined together the extension or tongue 159 of one of wall members 101 is connected by friction fit into groove 160 of the other adjacent wall member 101. A first resiliently deformable gasket 124 is positioned longitudinally between adjacent sides of wall members 101 on the side of the extension or tongue 159 toward outer side 207 of wall members 101. A second resiliently deformable gasket 125 is positioned longitudinally within groove 160 to contact extension or tongue 159. Gaskets 124 and 125 are configured to be compressed to form a seal between adjacent wall members 101 when wall members 101 are joined together in this manner.

As seen best in FIG. 16*a*, wall members 101 include openings 216 which are aligned when walls 101 are joined together. This permits access to plate 114 and screws 115 when securing or releasing wall members 101 from attachment to each other.

It should be noted that frames 116 of wall members 101 include outer vertical sections which, when adjacent wall members are in side-by-side attachment are adjacent one another. Plate 114 secures adjacent wall members 101 together by rigidly attaching those adjacent frame segments together, as seen best in FIG. 22*c*.

It should also be noted that base member 201 of plate 114 is dimensioned such that lateral extensions 203 are positioned about those frame segments to secure wall members 101 together with gaskets 124 and 125 compressed to form the seal, when the wall members 101 are connected together.

Figure 16B:
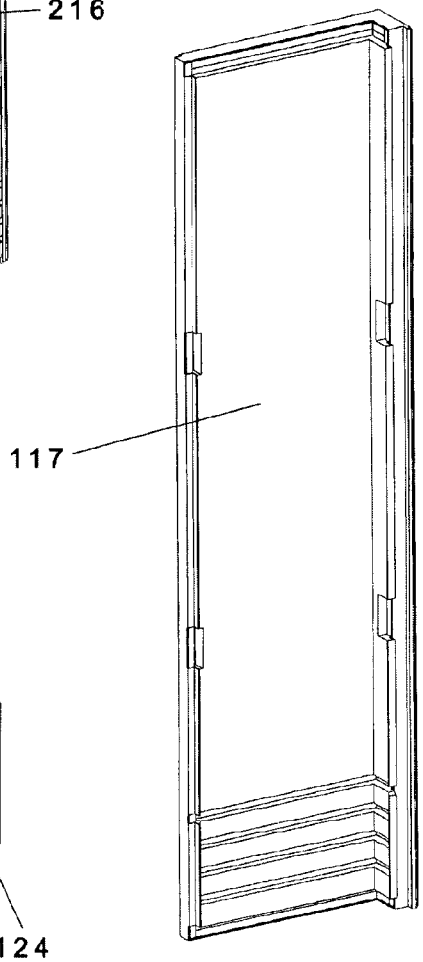
FIG. 16*b* is a perspective view of the inside of a one piece corner panel, of the dwelling of FIG. 14*a*.
Figure 16C:
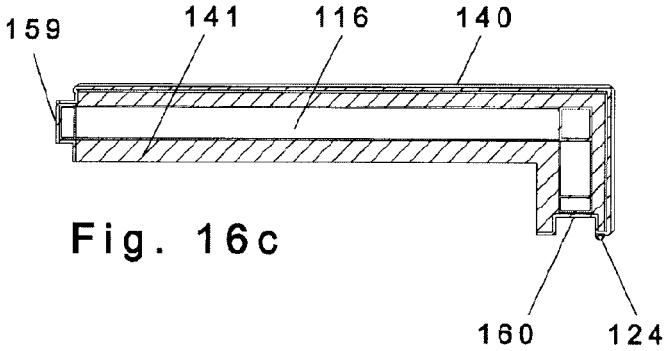
FIG. 16*c* is a cross sectional view of a one piece corner panel showing the internal frame structure, of the dwelling of FIG. 14*a*.

FIGS. 16*b* and 16*c* depict a corner panel 117 which forms an aesthetically pleasing joint between two perpendicular corners of the dwelling. The corner detail is molded into the outer plastic skin 140 and the internal steel tube frame 116 has a perpendicular welded construction and is encased in foam in the same manner as wall member 101. The corner panel 117 has the same tongue 159 and groove 160 system as the flat wall members 101 and it uses the same bent steel plates 114 to attach the corner panel to the adjacent panels.

It should be understood that all panels when in use are filled with foam to provide rigidity to the composite panels and insulation to the dwelling. Panels 101 are seen in exploded view in FIG. 22*a*.

FIG. 17*a* depicts a cross-sectional view of a truss member 109 of truss system 102. Upper chord 167 extends from one end of truss system 102 to the other at the top of truss system 102 and lower chord 165 extends from one end of truss system 102 to the other at the bottom in parallel alignment with upper chord 167. Lower chord 165 includes channel 118 including support 171 extending from one end of truss system 102 to the other. FIG. 17*a*, inner or first end 173 of flat lower roof panel 122 is secured into the C-section of channel 218 of each truss member 109 with screws in pre-drilled holes in lower chord 165 of truss members 109 and its intersection with the internal steel tube frame structure of the lower roof panel 123 of lower roof 122. Inner or first end 179 of upper roof assembly 121 is secured in the same fashion using the pre-drilled holes in the upper chord 167 of truss members 109. Flashing (not shown) is positioned under the truss windows 119 or panels over the roof panel 122 to assist in the flow of rainwater from truss members 109 onto roof panel 122.

In one embodiment of the invention, compressive loads experienced by upper chord 167 of the truss system 102 are carried through bottom chord 165 of the truss assembly 102 and the ends of the truss assembly 102 via four angled tubular supports 125 in each truss member 109. These supports 125 are welded to both the upper and lower chords 167,165 of the truss member 109.

Figure 17B:
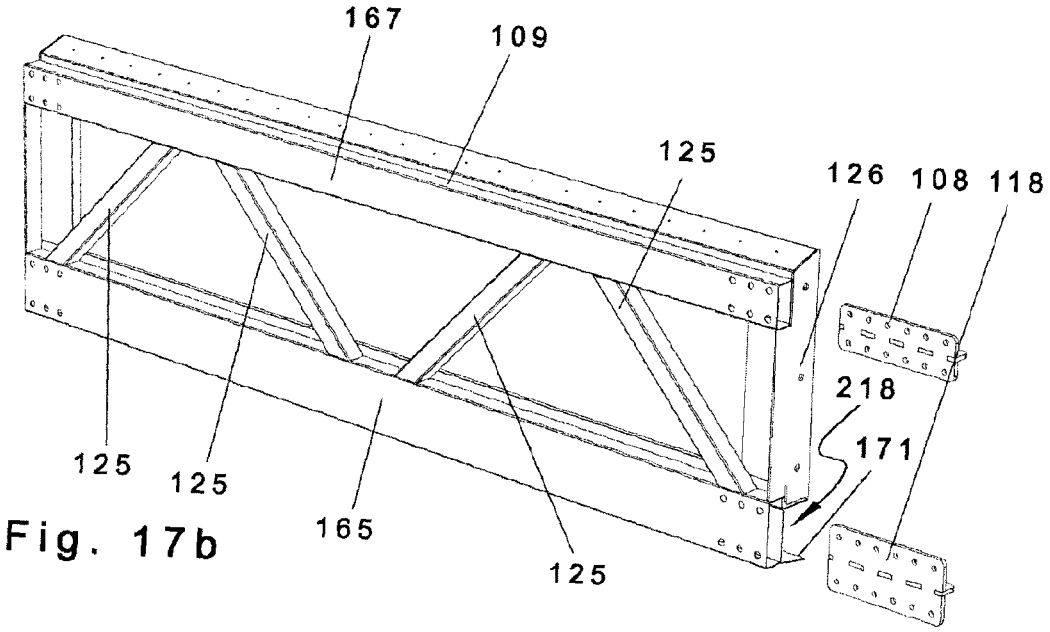
FIG. 17*b* is a perspective view of an end truss member of the five truss members that make up the truss system of the dwelling of FIG. 14*a*.

FIG. 17*b* provides a better view of the placement of the angled tubular supports 125 in a truss member 109. The five truss members 109 that comprise the truss system 102 in its entirety are bolted together on site. Each truss member 109 is secured to an adjacent truss member by two steel bridge plates 108, 118. A smaller steel bridge plate 108 secures the upper chords 167 of adjacent truss members 109, and a larger steel bridge plate 118 secures the lower chords 165 of the adjacent truss members 109.

In addition to bridge plates 108 and 118, three additional bolts are located at each joint between adjacent outer truss bolting plates 126 to keep this joint from separating once assembled. These three bolts are inserted through the pre-drilled holes placed in plates 126 welded onto the ends of each truss member 109.

Once the truss members 109 and roof panels 121, 122 are assembled, the final assembly of installing the five window panes 119 (FIG. 14*b*) can commence. Windows 119 are sealed from the elements with silicone or other suitable means and further secured using screws, such as four across the top of window 119, four across the bottom of window 119. Alternatively a pair of window panes 119 can run on separate tracks enabling windows 119 to be opened as desired.

FIG. 18*a* depicts fabricated steel lower corner bracket 161 that is placed at each corner of the dwelling, either onto concrete pad 33 (shown in FIG. 6) fastened with HILTI nails if the dwelling is built directly on concrete pad 33 or if on a subfloor, with fasteners placed at the four pre-drilled hole locations 130.

FIG. 18*b* shows upper roof bracket 162 that is used to secure steeper roof panel assembly 122 to the top of wall members 101 this bracket is also responsible for carrying any compressive loads from the roof and directing those loads over the wall member 101 and into the internal tubular steel frame 116 inside the panels 101. Brackets 162 are fastened on site, the small groove 128 in the exposed faces of the flanges is used as a guide for drilling holes in flange 189 so that the installation crew will properly place the holes and screws during assembly. Bracket 162 also incorporates two gasket grooves 127, for adhesive backed rubber gaskets, creating a watertight seal at these two joints.

FIG. 18*c* shows bracket 163 that is used to secure the less steep roof panel assembly 121 to the top of wall members 101. Bracket 163 also incorporates a guide groove 128 on flange 193 for more accurate onsite installation and two gasket grooves 127 for the installation of adhesive backed rubber gaskets. The two rubber gaskets on each bracket 162, 163 are similar or identical to gaskets 124, 125 shown in FIG. 22*c*.

Figure 19:
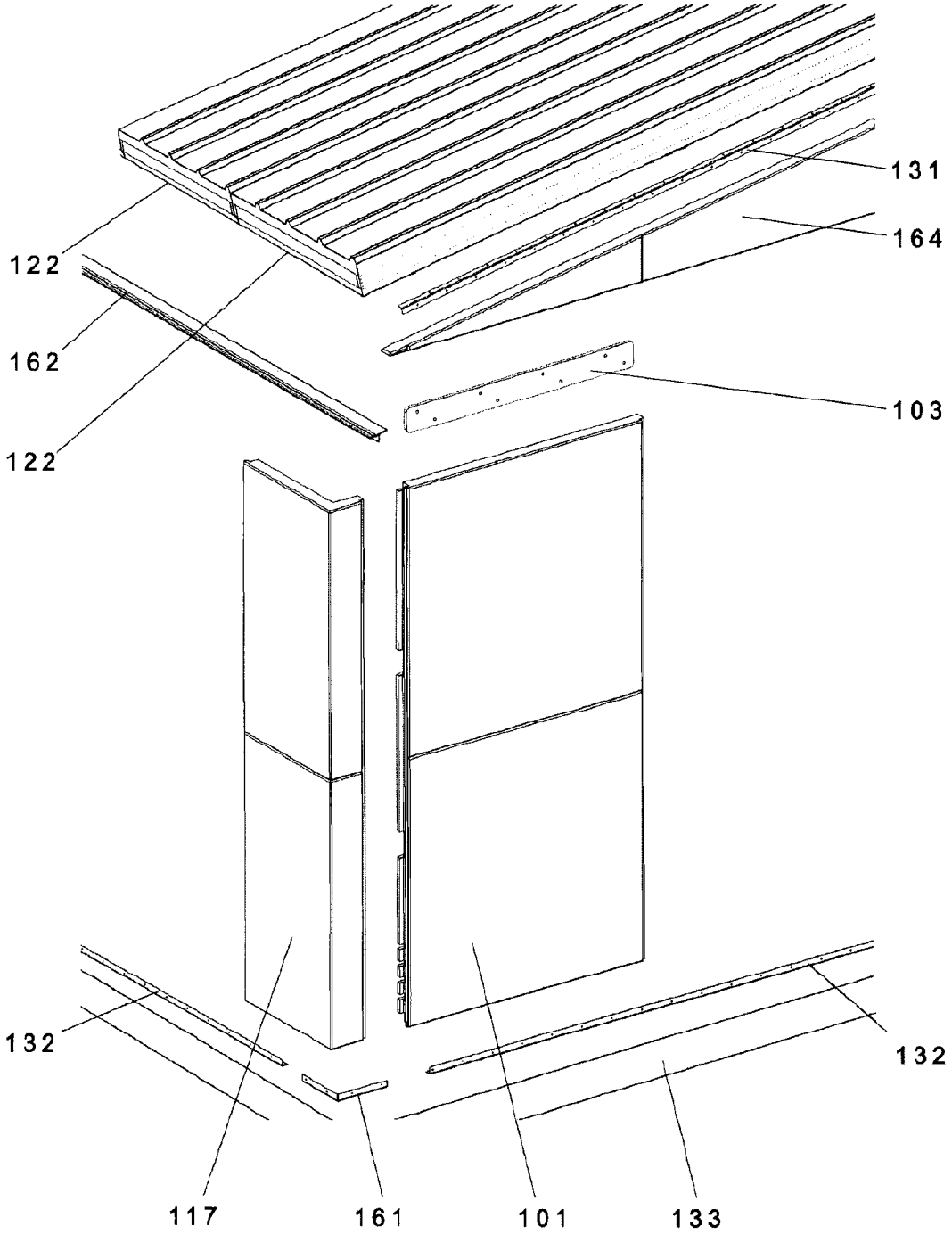
FIG. 19 is an exploded perspective view of an outside corner of the dwelling of FIG. 14*a* showing the steel brackets used to affix the wall panels to the sub-floor or concrete pad and the steel brackets used to affix the roof panels to the top of the wall panels.

As shown in FIG. 19, where wall members 101 are not being installed at a corner of the dwelling, a straight steel bracket 132 which may measure 3 m for example is installed using assembly techniques similar to those described above for corner bracket 161.

Figure 20:
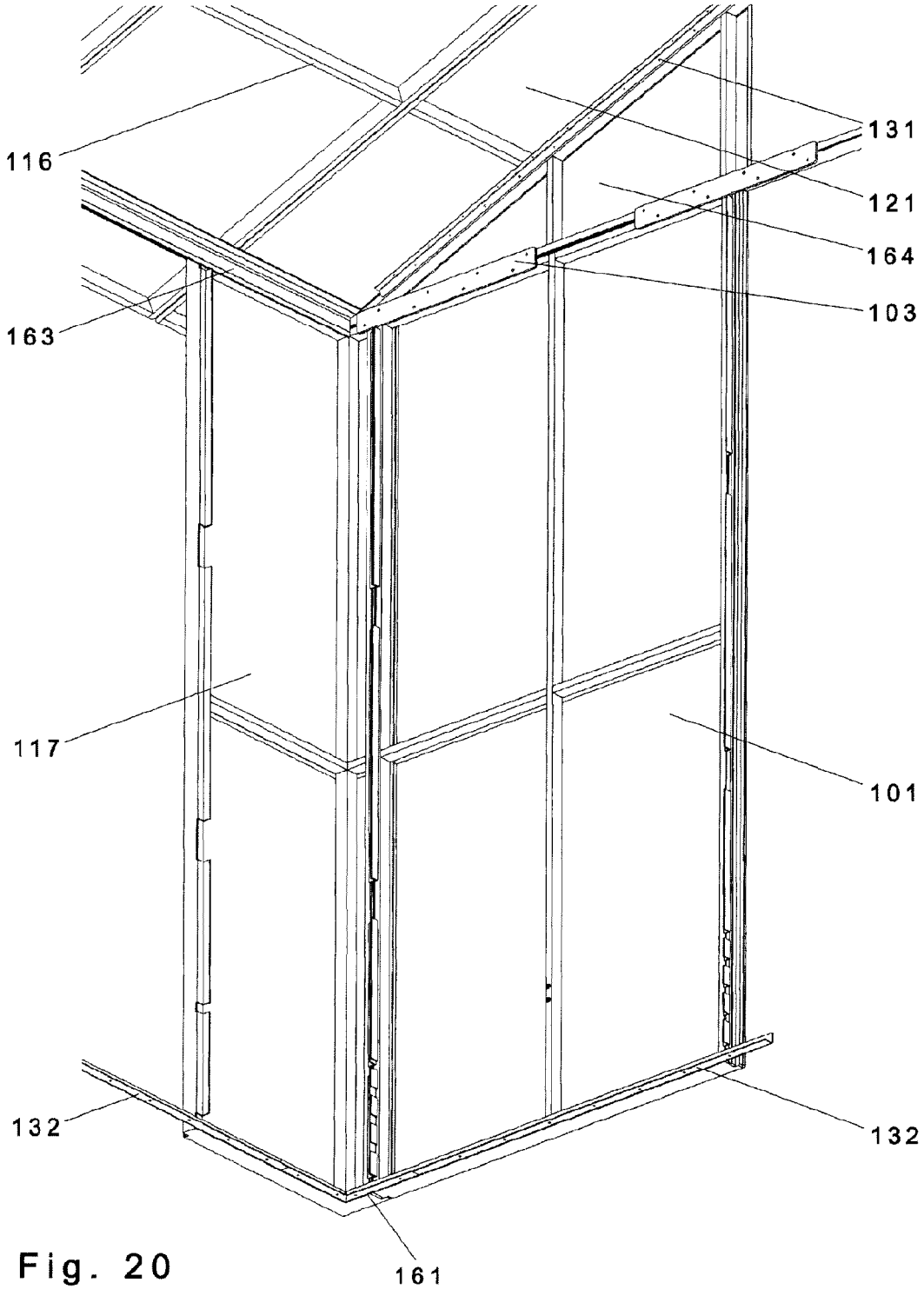
FIG. 20 is a perspective view, viewed from below of an inside corner of the dwelling of FIG. 14*a* showing the connection details between the sub-floor, wall panels and roof panels.

As shown in FIGS. 19 and 20, once brackets 161 and 132 are installed onto the sub-floor or concrete pad 33, the erection of the walls can commence. Wall members 101 are secured to lower corner brackets 161 via pre-drilled holes 129 in bracket 161, and are fastened using self drilling screws that align with the internal steel tube frame 116 that is located inside wall members 101. Then, as shown in FIG. 19, upper roof bracket 162 is affixed to the wall members 101 via self drilling screws drilled through the guide 128 on roof bracket 162. The binding plate 103 is placed in the corner between the wall member 101 and triangular gable end panel 164, by means of self drilling screws that affix binding plate 103 to the internal steel tube frames 116 of panels 101 and 164.

As shown in FIG. 20 lower roof bracket 163 is used to secure the second end region 181 of roof panel assembly 121 to the top of the wall members 101 by attaching assembly 121 to bracket 163 using screws that intersect the tubular frame members 116 located in the roof panel assembly 121. Similarly, and with reference to FIG. 19, roof bracket 162 is used to secure the second end region 175 of roof panel assembly 122 to the top of the wall members 101 by attaching assembly 122 to bracket 162 using screws that intersect the tubular frame members 116 located in roof panel assembly 122.

For straight sections of wall panels that intersect the roof panel assemblies 121, 122 at perpendicular angles bent steel brackets 131 are affixed to the inside corner creating a rigid connection between the top of gable end panel 164 and roof panel assemblies 121, 122. This connection is particularly important in locations that experience high wind speeds as the roof panels can experience significant (negative) lift forces due to high speed winds flowing over the roof profile.

It should be understood that while panels 101 are shown in FIG. 20 with internal frame members in view, when in use panels 101 are filled with foam to provide rigidity to panels 101 and insulation to the dwelling. Panels 101 are seen in exploded view in FIG. 22*a*.

Figure 21A:
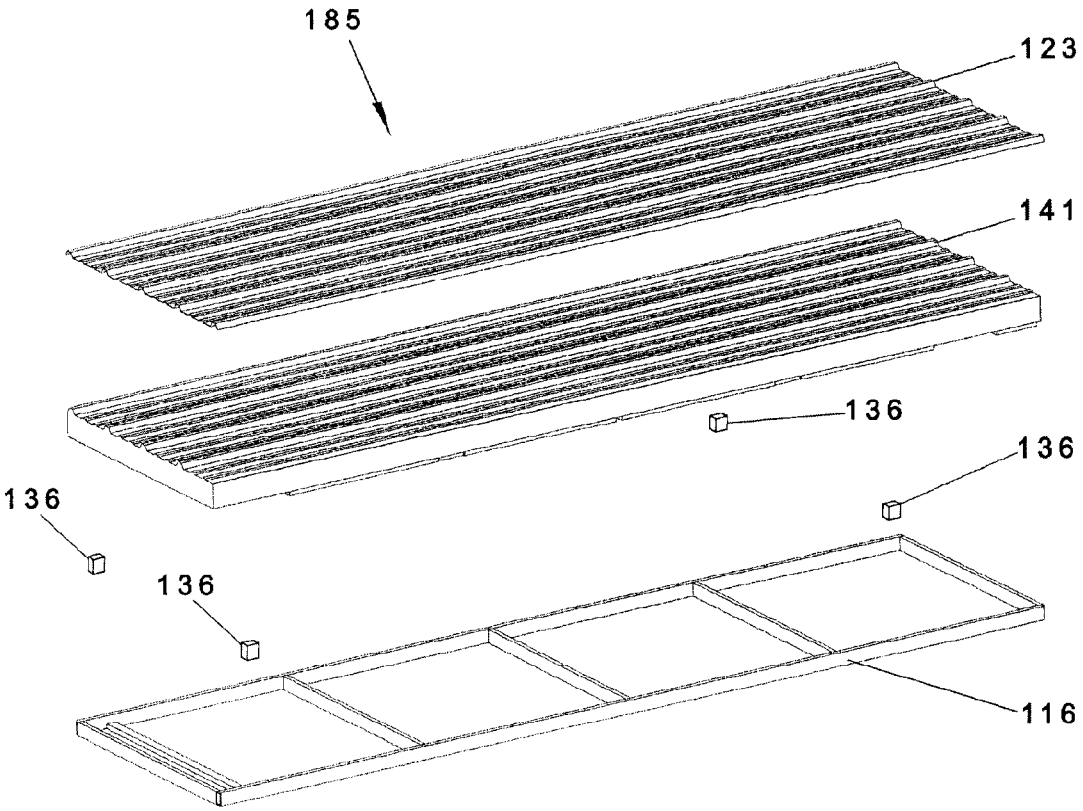
FIG. 21*a* is an exploded perspective view of a roof panel of the dwelling of FIG. 14*a*.
Figure 21B:
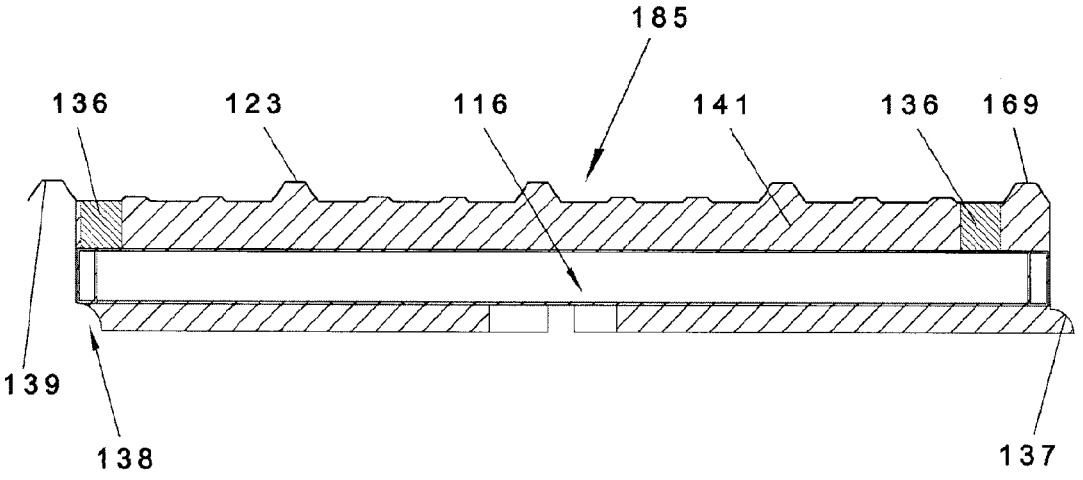
FIG. 21*b* is a cross-sectional view of a roof panel of the dwelling of FIG. 14*a*.

As shown in FIGS. 21*a* and 21*b*, the insulated composite roof panel assemblies 121 and 122 used in the construction of the modular dwelling are made up of a plurality of roof panels 185. Each panel 185 consists of an internal rectangular steel tube frame 116, which could be made from ¾"×2" (19 mm×50 mm) 14 gauge steel tubes for example. Frame 116 is inserted into a mold and cast inside a composite roof panel 185, which consists of 125 mm thick blank of foam 141 that is adhered to a thin gauge corrugated metal roof plate 123 and the internal steel frame. The frame is supported at a proper depth using blocks 136 which may be 2 lb density STYROFOAM for example that suspend frame 116 at the correct height before casting commences, encasing the metal tube frame 116 in polyurethane foam. The encased frame 116 provides structure to the composite roof panels 185 and also provides a tough substrate for installing and retaining the roof panels 185 in place. Plate 123 of the roof panel 185 includes an overlapping groove 139 that engages with tongue 169 to overlap each seam between adjacent roof panels 185 protecting the inside of the dwelling from water penetration. An additional tongue 137 and groove 138 on the bottom edge of panel 185 also ensures an additional seal at each of the seams.

Roof panels assemblies 121 and 122 are pitched away from the center of the house allowing rain water and melting snow to travel away from the center of the dwelling out to a peripheral edge where it can fall off the roof outside of the dwelling's envelope. A gutter system (not shown) can then capture the water and redirect it to an exterior drain. Both roof panel assemblies 121 and 122 are shown identical in design and length, although roof panel assembly 122 is pitched at a higher angle due to the height difference between the bottom and top of the truss members 109. As alternatives roof panels 121 and 122 could be different lengths (with adjustment of the truss system 102 position) and in design, as compared to each other.

As shown in FIGS. 22*a*, 22*b* and 22*c*, the insulated composite wall members 101 used in the construction of the modular dwelling each consist of an internal rectangular steel tube frame 116, made from steel tubes. Frame 116 is inserted inside shell 140 which may be vacuum formed that is molded with the back side open. The frame is supported at the proper depth using blocks 142 which may be 2 pound density STYROFOAM inserted into the plastic shell 140. Two foam blocks 142 are placed inside the shell 140 in the outer corners on the groove 212 side of the panel. The other side of frame 116 fits into the inside of extension 159 and is supported therein in the same plane as frame 116 is supported by blocks 142 (sometimes referred to as spacers). Frame 116 is positioned in plastic shell 140, and rests on the two blocks 142 and within the tongue on the other side, positioning the steel tube frame 116 generally in the middle of the composite panel. Once the assembly of wall member 101 is completed the vertical portion of frame 116 fitted within the inside of extension or tongue 159 provides additional structural support to extension or tongue 159.

Foam 141 preferably polyurethane is cast into plastic shell 140, encasing steel tube frame 116 inside polyurethane foam 141. Hence, wall members 101 comprise a plastic shell 140 which forms a protective tough outer skin, reinforced by steel tube frame 116 and insulated by polyurethane foam 141. During casting, polyurethane foam 141 adheres to the inner surfaces of plastic shell 140 and steel tube frame 116, creating a rigid structural wall member 101 capable of protecting the dwelling from the outdoor elements and insulating it from fluctuations in outdoor temperature. The lack of organic materials used in the construction of the wall panels ensures that they will not break down over time with exposure to moisture and other factors that typically attack organic materials used in construction.

From the foregoing, it will be appreciated that specific embodiments of the invention have been described herein for purposes of illustration, but that various modifications may be made without deviating from the spirit and scope of the various embodiments of the invention. For example, where reference is made to metal or steel roof members other alloys such as aluminum may be suitable in addition to fiberglass or composite sheet material. And while steel or metal is described for use in frames in the roof and the wall including the truss(es) they could be made of fiberglass/composite or a wooden product including engineered laminated plywood. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

The invention claimed is:

1. A modular dwelling, comprising:

(a) a plurality of wall members attached together to enclose an interior of the modular dwelling;

(b) a truss system extending across the dwelling supported at each end by a vertical post, the truss system positioned horizontally with a lower chord and an upper chord;

(c) the lower chord defining a support and wherein the support defines a channel with upper and lower horizontal members and a supporting surface within the channel;

(d) a lower roof member comprising a first end supported by the supporting surface, the lower roof member further comprising a second end region opposite the first end supported by a first wall section of the wall members;

(e) an upper roof member comprising a first end supported by the upper chord, the upper roof member further comprising a second end region opposite the first end, in a direction opposite to that of the lower roof member, supported by a second wall section of the wall members;

wherein the upper surface of the second wall section and the upper surface of the truss system are angled in co-planar alignment in an upper roof plane extending downwardly from the upper surface of the truss system to the upper surface of the second wall section; and wherein the truss system comprises a series of discrete truss members connected together in end to end linear alignment wherein each truss comprises upper and lower channels, each upper and lower channel extending inwardly from upper and lower ends of each truss member and further comprising a plurality of connectors each connector dimensioned to fit within the upper or lower channel of adjacent truss members and connectable thereto to secure the adjacent truss members together.

2. The modular dwelling of claim 1, wherein the support of the lower roof member is oriented above the first wall section so that the lower roof member is slanted downwardly from the first end to the second end region.

3. The modular dwelling of claim 2 wherein the upper surface of the first wall section and the supporting surface of the support are angled in co-planar alignment in a lower roof plane extending downwardly from the supporting surface of the support to the upper surface of the first wall section.

4. The modular dwelling of claim 3 wherein the first wall section further comprises a lower roof extension extending inwardly from the first wall section along the lower roof plane.

5. The modular dwelling of claim 4 wherein the upper and lower roof members comprise a plurality of roof sections aligned along their longitudinal sides, each roof section comprising:

(a) a first groove extending laterally along a first longitudinal side of the roof section having a concave inner region extending along the first side facing downwardly when the roof section is on the dwelling and a first tongue extending upwardly from the upper face of the roof section along the opposite longitudinal side of the roof section configured to mate with the first groove, the first groove of a roof section covering a first tongue of an adjacent roof section when the roof section is on the dwelling; and (b) a second groove having a concave inner region facing laterally in the direction of the lateral extension of the first groove extending along the first longitudinal side and a second tongue extending laterally along the opposite longitudinal side of the roof section configured to mate with the second groove, the second groove of a roof section covering a second tongue of an adjacent roof section when the roof section is on the dwelling.

6. The dwelling of claim 2 wherein the vertical posts are dimensioned in length so that the support surface is positioned above the plane of the upper periphery of the first wall section.

7. The modular dwelling of claim 1, wherein the second wall section further comprises an upper roof extension extending inwardly from the second wall section along the upper roof plane.

8. The modular dwelling of claim 7 wherein the upper and lower roof members comprise a plurality of roof sections aligned along their longitudinal sides, each roof section comprising:

(a) a first groove extending laterally along a first longitudinal side of the roof section having a concave inner region extending along the first side facing downwardly when the roof section is on the dwelling and a first tongue extending upwardly from the upper face of the roof section along the opposite longitudinal side of the roof section configured to mate with the first groove, the first groove of a roof section covering a first tongue of an adjacent roof section when the roof section is on the dwelling; and (b) a second groove having a concave inner region facing laterally in the direction of the lateral extension of the first groove extending along the first longitudinal side and a second tongue extending laterally along the opposite longitudinal side of the roof section configured to mate with the second groove, the second groove of a roof section covering a second tongue of an adjacent roof section when the roof section is on the dwelling.

9. The modular dwelling of claim 1, wherein the supporting surface of the support and the upper periphery of the first wall section is substantially co-planar so that the lower roof member is substantially horizontal.

10. The modular dwelling of claim 9, wherein the upper and lower sides of the lower roof member are tapered so that the upper surface of the lower roof member is slanted downwardly from the first end to the second end region.

11. The modular dwelling of claim 1, wherein the truss system is positioned in a central region of the dwelling so that the distance between respective first and second end regions of the upper and lower roof members is approximately equal.

12. The modular dwelling of claim 1, wherein the upper chord and lower chord define a cavity between them.

13. The dwelling of claim 12 further comprising a window within the cavity.

14. The modular dwelling of claim 1, wherein the upper and lower roof members each comprising a plurality of roof panels connected together at contacting edges and extending from a first end supported by the truss and a second end region supported by the first and second wall sections.

15. The dwelling of claim 14 wherein the roof panels comprise an upper face with one or more ridges extending upwardly from the face and longitudinally along the panels adjacent at least one contacting edge of the panels.

16. The dwelling of claim 15 further comprising groove members covering at least a part of the ridges and the abutting edges of adjacent panel members.

17. The dwelling of claim 15, wherein the roof panel members comprise:

(a) an outer shell forming an inner region;

(b) an internal rigid frame within the inner region;

(c) a resiliently deformable filler material filling the inner region.

18. The dwelling of claim 17 wherein at least a portion of the frame of a roof panel covering all or a part of an adjacent wall section is positioned so that the frame contacts the wall section in order to provide support of the roof panel by the frame resting on the adjacent wall section.

19. The dwelling of claim 18 wherein the underside of the roof panels further comprise non-deformable attachment segments attached to the portion of the frame and aligned with the tops of adjacent wall sections and further comprising connectors connecting the roof panels to the tops of adjacent wall sections by means of the attachment segments.

20. A modular dwelling, comprising:

(a) a plurality of wall members attached together to enclose an interior of the modular dwelling;

(b) a truss system extending across the dwelling supported at each end by a vertical post, the truss system positioned horizontally with a lower chord and an upper chord;

(c) the lower chord defining a support and wherein the support defines a channel with upper and lower horizontal members and a supporting surface within the channel;

(d) a lower roof member comprising a first end supported by the supporting surface, the lower roof member further comprising a second end region opposite the first end supported by a first wall section of the wall members;

(e) an upper roof member comprising a first end supported by the upper chord, the upper roof member further comprising a second end region opposite the first end, in a direction opposite to that of the lower roof member, supported by a second wall section of the wall members;

wherein the upper surface of the second wall section and the upper surface of the truss system are angled in co-planar alignment in an upper roof plane extending downwardly from the upper surface of the truss system to the upper surface of the second wall section;

wherein the second wall section further comprises an upper roof extension extending inwardly from the second wall section along the upper roof plane; and wherein the upper and lower roof members comprise a plurality of roof sections aligned along their longitudinal sides, each roof section comprising:

a first groove extending laterally along a first longitudinal side of the roof section having a concave inner region extending along the first side facing downwardly when the roof section is on the dwelling and a first tongue extending upwardly from the upper face of the roof section along the opposite longitudinal side of the roof section configured to mate with the first groove, the first groove of a roof section covering a first tongue of an adjacent roof section when the roof section is on the dwelling; and a second groove having a concave inner region facing laterally in the direction of the lateral extension of the first groove extending along the first longitudinal side and a second tongue extending laterally along the opposite longitudinal side of the roof section configured to mate with the second groove, the second groove of a roof section covering a second tongue of an adjacent roof section when the roof section is on the dwelling.

21. A modular dwelling, comprising:

(a) a plurality of wall members attached together to enclose an interior of the modular dwelling;

(b) a truss system extending across the dwelling supported at each end by a vertical post, the truss system positioned horizontally with a lower chord and an upper chord;

(c) the lower chord defining a support and wherein the support defines a channel with upper and lower horizontal members and a supporting surface within the channel;

(d) a lower roof member comprising a first end supported by the supporting surface, the lower roof member further comprising a second end region opposite the first end supported by a first wall section of the wall members;

(e) an upper roof member comprising a first end supported by the upper chord, the upper roof member further comprising a second end region opposite the first end, in a direction opposite to that of the lower roof member, supported by a second wall section of the wall members;

wherein the upper surface of the second wall section and the upper surface of the truss system are angled in co-planar alignment in an upper roof plane extending downwardly from the upper surface of the truss system to the upper surface of the second wall section;

wherein the support of the lower roof member is oriented above the first wall section so that the lower roof member is slanted downwardly from the first end to the second end region;

wherein the upper surface of the first wall section and the supporting surface of the support are angled in co-planar alignment in a lower roof plane extending downwardly from the supporting surface of the support to the upper surface of the first wall section;

wherein the first wall section further comprises a lower roof extension extending inwardly from the first wall section along the lower roof plane; and wherein the upper and lower roof members comprise a plurality of roof sections aligned along their longitudinal sides, each roof section comprising:

a first groove extending laterally along a first longitudinal side of the roof section having a concave inner region extending along the first side facing downwardly when the roof section is on the dwelling and a first tongue extending upwardly from the upper face of the roof section along the opposite longitudinal side of the roof section configured to mate with the first groove, the first groove of a roof section covering a first tongue of an adjacent roof section when the roof section is on the dwelling; and a second groove having a concave inner region facing laterally in the direction of the lateral extension of the first groove extending along the first longitudinal side and a second tongue extending laterally along the opposite longitudinal side of the roof section configured to mate with the second groove, the second groove of a roof section covering a second tongue of an adjacent roof section when the roof section is on the dwelling.

* * * * *